US005912099A

United States Patent [19]

Kanbayashi et al.

[11] Patent Number: 5,912,099

[45] Date of Patent: Jun. 15, 1999

[54] MAGENTA TONER, PROCESS FOR PRODUCING SAME AND COLOR IMAGE FORMING METHOD USING SAME

[75] Inventors: Makoto Kanbayashi, Shizouka-ken; Masaaki Taya, Mishima; Ryoichi Fujita, Odawara; Wakashi Iida, Numazu; Tetsuya Ida, Mishima, all of Japan

[73] Assignee: Canon Kabushiki Kaisha, Tokyo, Japan

[21] Appl. No.: 08/904,476

[22] Filed: Aug. 4, 1997

[30] Foreign Application Priority Data

Aug. 2, 1997 [JP] Japan ..... 8-219077

[51] Int. Cl.[6] ..... G03G 9/08

[52] U.S. Cl. ..... 430/106; 430/124; 430/137

[58] Field of Search ..... 430/45, 106, 109, 430/124, 137

[56] References Cited

U.S. PATENT DOCUMENTS

| | | | |
|---|---|---|---|
| 4,777,105 | 10/1988 | Macholdt et al. | 430/109 |
| 5,437,949 | 8/1995 | Kanbayashi et al. | 430/45 |
| 5,561,013 | 10/1996 | O'Brien et al. | 430/45 |
| 5,707,769 | 1/1998 | Hagi et al. | 430/106 |

FOREIGN PATENT DOCUMENTS

| | | |
|---|---|---|
| 49-27228 | 3/1974 | Japan . |
| 57-54954 | 4/1982 | Japan . |
| 61-91666 | 5/1986 | Japan . |
| 61-117565 | 6/1986 | Japan . |
| 61-156054 | 7/1986 | Japan . |
| 62-291669 | 12/1987 | Japan . |
| 63-018628 | 4/1988 | Japan . |
| 64-9466 | 1/1989 | Japan . |
| 1-142559 | 6/1989 | Japan . |
| 1-154161 | 6/1989 | Japan . |
| 4-36972 | 2/1992 | Japan . |
| 4-39671 | 2/1992 | Japan . |
| 4-242752 | 8/1992 | Japan . |
| 5-34978 | 2/1993 | Japan . |

OTHER PUBLICATIONS

Patent Abstracts of Japan, vol. 095, No. 001, Feb. 1995 for JP–06 282117.

Patent Abstracts of Japan, vol. 013, No. 422, (P–933) Sep. 1989 for JP–01 154161.

Database WPI, Section Ch, Week, 8422, Derwent, Class A89, AN 84–136148 for JP 58–189652.

*Primary Examiner*—John Goodrow

*Attorney, Agent, or Firm*—Fitzpatrick, Cella, Harper & Scinto

[57] ABSTRACT

A magenta toner for developing electrostatic images is formed of a binder resin, and a quinacridone pigment providing an X-ray diffraction spectrum showing two peaks in a Bragg angle (2θ) region of 5–10 deg. The magenta toner has an improved light fastness, may have a desired hue comparable to a printing process ink and is suitably used for electrophotographic full-color image formation. The magenta toner may preferably be formed through a process including a first kneading step starting from wet blending of a binder resin and two paste pigments including quinacridone and 2,9-dimethylquinacridone, respectively, under mild conditions not causing crystal transformation to form a master batch and a second kneading step of diluting the master batch together with other additive.

47 Claims, 6 Drawing Sheets

MAGENTA TONER, PROCESS FOR PRODUCING SAME AND COLOR IMAGE FORMING METHOD USING SAME

FIELD OF THE INVENTION AND RELATED ART

The present invention relates to a magenta toner for developing electrostatic images for use in electrophotography, electrostatic recording, electrostatic printing, etc., and a process for production thereof. The present invention also relates to a developer containing the magenta toner and a color image forming method using the magenta toner.

In recent years, computer appliances for personal users have been continually reduced in price, and full-color image data transmission system has been developed for visual data transmission. Along with these developments, an image forming apparatus, such as a printer or a copying apparatus, as an output means has been rapidly adapted for full-color usage especially in respects of lower grade models, so that ordinary users are also becoming familiar with color images.

As such full-color image outputting apparatus, there have been known many systems including the thermal transfer system, the ink ribbon system, and the ink jet system, whereas the electrophotography is still predominant as a whole. The electrophotographic system generally includes a process wherein an electric latent image is formed on a photosensitive member by various means utilizing a photoconductive substance and is developed with a toner to form a toner image, and the toner image, after being transferred onto a transfer-receiving material such as paper as desired, is fixed by application of heat, pressure, heat and pressure, or solvent vapor to provide a fixed toner image.

In the case of a full color image formation, a full color image is reproduced by using three chromatic color toners of yellow, magenta and cyan as three primary colors, or four color toners further including a black toner. For example, light from an original is caused to pass through a color separation filter having a color complementary to that of a toner and then illuminate a photoconductor layer to form an electrostatic latent image thereon. The latent image is then developed and the resultant toner image is transferred onto a support material. The above-mentioned steps are repeated while effecting registration to form superposed color toner images, which are then fixed to provide a final full-color image.

In recent years, there are increasing demands for a high image quality and a high resolution of full-color images. To ordinary users accustomed to printed full-color images, full-color copied images are not yet at a satisfactory level, and they require a higher level of images closer to printed images and photographic images. More specifically, copied images are desired to exhibit a uniformity of solid image over a broad image area and a uniformity of halftone image and realize a broad dynamic range from a high density to a low density, so that it is urgently required to develop a toner allowing a high image density output, a color hue comparable to that obtained by printing, an excellent light transmittance suitable for an OHP transparency and excellent light-fastness.

Accordingly, a colorant used in a toner is naturally also required to have a high coloring power, be excellent in clarity and transparency, be excellent in light-fastness and be excellent in dispersibility in a resin.

On the other hand, as it becomes more frequent for a color copying apparatus to be connected to a computer via a controller to be used as a high-quality color printer, a color management system effecting color control for an entire system has been proposed. As a result, some users strongly desire that an output image formed by an electrophotographic color copying apparatus is identical in hue to an output image formed by a process ink-based printing, so that a toner having an identical hue with a process ink is becoming required.

Some pigments have been proposed for constituting a magenta toner, whereas quinacridone pigments have been widely used because of excellent color clarity and transparency and excellent light-fastness.

Japanese Laid-Open Patent Application (JP-A) 49-27228, JP-A 57-54954 and JP-A 1-142559 have disclosed a toner containing 2,9-dimethylquinacridone alone. The toner is actually excellent in light fastness but cannot be said as a sufficiently clear magenta toner.

JP-A 64-9466 has disclosed a combination of a quinacridone pigment and a xanthene dye or a laked pigment of xanthene dye so as to provide a toner with an improved clarity. The toner however does not acquire a sufficient clarity, and the color is changed so that the resultant image causes a color change after standing for long hours.

JP-A 1-154161 has disclosed to use a quinacridone pigment having an average particle size of at most 0.5 $\mu$m so as to provide a toner with an improved transparency. However, the transparency of a toner is determined based on a pigment, a resin, and a manner and a degree of dispersion of the pigment in the resin, and a magenta toner having a high transparency has not been necessarily attained.

On the other hand, in the case of a full-color image, color reproduction is effected by using three chromatic color toners of yellow, magenta and cyan as three primary colors, or four color toners additionally including a black toner thereto, so that a color balance with other colors is important for obtaining an image of a desired hue, and some trials have been made for slightly changing the color hue of a magenta toner.

For example, Japanese Patent Publication (JP-B) 63-18628 has disclosed a mixture of two species of substituted quinacridone, and JP-A 62-291669 has disclosed to use a mixed crystal of 2,9-dimethylquinacridone and non-substituted quinacridone as a magenta colorant having an objective hue and capable of providing a toner with an improved triboelectric chargeability.

The mixture or mixed crystal has caused a shift of hue to a yellowish side as a whole compared with a single use of 2,9-dimethylquinacridone but is still bluish when compared with the hue of a magenta ink for offset printing, thus leaving much room for improvement.

Also many studies have been made so as to improve the dispersibility of a colorant in a toner.

JP-A 61-117565 and JP-A 61-156054 have disclosed a process of dispersing a binder resin, a colorant, a charge control agent, etc., in a solvent in advance, and removing the solvent to obtain a toner. The process involves problems such that the control of dispersion of the charge control agent is difficult and the solvent is liable to remain in the product toner to provide an undesirable odor.

JP-A 61-91666 has disclosed a toner production process using a halogen-containing solvent, but the process involves a problem that the colorant used is restricted because of a strong polarity of the halogen-containing solvent.

JP-A 4-39671, JP-A 4-39672 and JP-A 4-242752 have disclosed a process for producing a toner under application of heat and pressure in a kneader. The process is really preferable for dispersion of a colorant, but the molecular chains of a binder resin constituting the toner are liable to be severed under a strong kneading load and a partial molecular weight decrease of the polymer is caused. Accordingly, the resultant toner is liable to cause a high-temperature offset. Particularly, in full-color copying, a stack of three color or four color toner layers is fixed, so that the latitude of anti-high-temperature offset is severely restricted than in the case of a monochromatic toner, and a slight molecular chain severance in the polymer is easily liable to result in high-temperature offset.

JP-A 5-34978 has disclosed a process of charging a resin and an aqueous process cake of pigment in a kneading machine and kneading the mixture under heating to disperse the pigment in the resin. The process is really preferred for dispersion of the pigment, but no reference is made to a pigment prepared by paying attention to a hue and a color reproducibility of the resultant toner.

SUMMARY OF THE INVENTION

An object of the present invention is to provide a magenta toner having a high coloring power capable of a broad dynamic range ranging from a low density to a high density, having high saturation and brightness, capable of providing an excellent OHP transparency, an excellent colorant dispersibility, good light fastness and a hue identical to magenta of a process ink.

Another object of the present invention is to provide a magenta toner having good fixability and color mixability, a sufficient triboelectric chargeability, a high gloss for providing a high image quality, a sufficient anti-high-temperature offset characteristic and a broad fixable temperature range, little liability of toner melt-sticking onto members in a developing device, such as a sleeve, a blade and an application roller, a good cleanability and little liability of filming onto a photosensitive member.

A further object of the present invention is to provide a magenta toner which is less liable to cause fog, excellent in highlight reproducibility, capable of providing an image excellent in solid portion uniformity, and excellent in continuous image forming performance.

According to the present invention, there is provided a magenta toner for developing electrostatic images, comprising: a binder resin, and a quinacridone pigment providing an X-ray diffraction spectrum showing two peaks in a Bragg angle (2θ) region of 5–10 deg.

According to the present invention, there is further provided a two-component type developer comprising the above-mentioned magenta toner and a carrier.

The present invention further provide a color image forming method, comprising:

forming a color toner image on a recording material with a combination of the above magenta toner and at least one color toner selected from a cyan toner and a yellow toner, and fixing the color toner image onto the recording material.

According to the present invention, there is further provided a process for producing a magenta toner, comprising the steps of:

blending a first binder resin, a first paste pigment (I) comprising a first dispersion medium and non-substituted quinacridone in 5–50 wt. % of the first paste pigment, and a second paste pigment (II) comprising a second dispersion medium and 2,9-dimethylquinacridone in 5–50 wt. % of the second paste pigment, under heating and under no pressure to melt the first binder resin, causing the quinacridone in the first paste pigment (I) and the 2,9-dimethylquinacridone in the second paste pigment (II) to migrate into the melted first binder resin, melt-kneading the first binder resin, the quinacridone and the 2,9-dimethylquinacridone to form a first kneaded product, drying the first kneaded product, melt-kneading a blend of the first kneaded product and a second binder resin to form a second kneaded product, cooling and pulverizing the second melt-kneaded product to obtain a magenta toner so that the magenta toner contains a quinacridone pigment providing an X-ray diffraction spectrum exhibiting two peaks in a Bragg angle (2θ) range of 5–10 deg.

These and other objects, features and advantages of the present invention will become more apparent upon a consideration of the following description of the preferred embodiments of the present invention taken in conjunction with the accompanying drawings.

DETAILED DESCRIPTION OF THE INVENTION

It is generally known that (non-substituted) quinacridone represented by the following structural formula (I) (hereinafter sometimes referred to as quinacridone (I)):

(I)

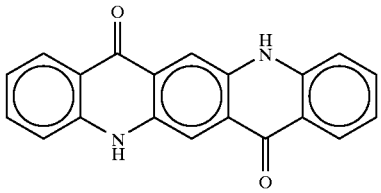

has crystal structures of α-form, β-form and γ-form. Regarding the light fastness, β-form is better than α-form, and γ-form is better than β-form.

Figure 3:
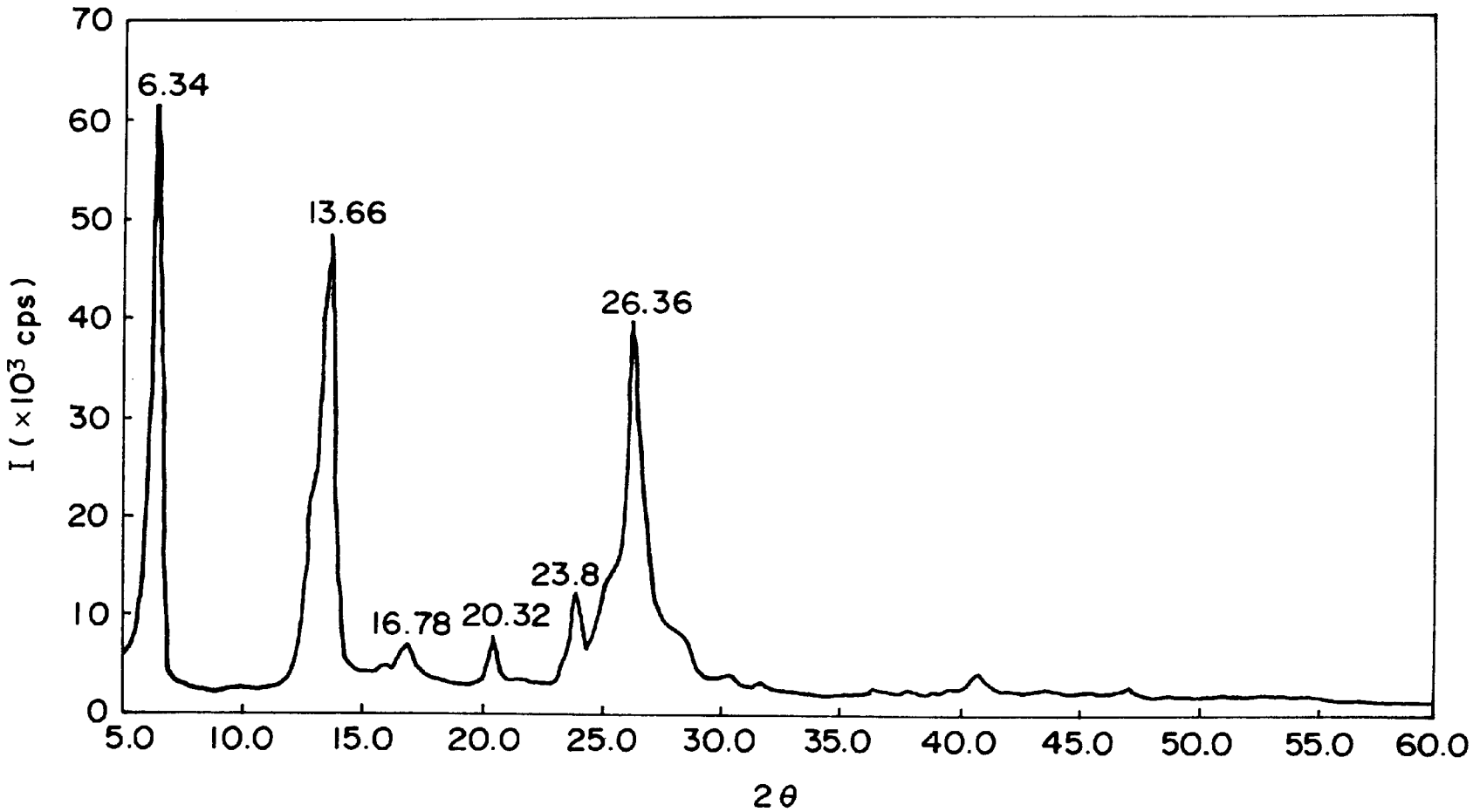
FIGS. 3 and 4 are X-ray diffraction spectra of γ-form quinacridone and 2,9-dimethylquinacridone, respectively, used as colorants for providing a magenta toner in Example 1.
Figure 5:
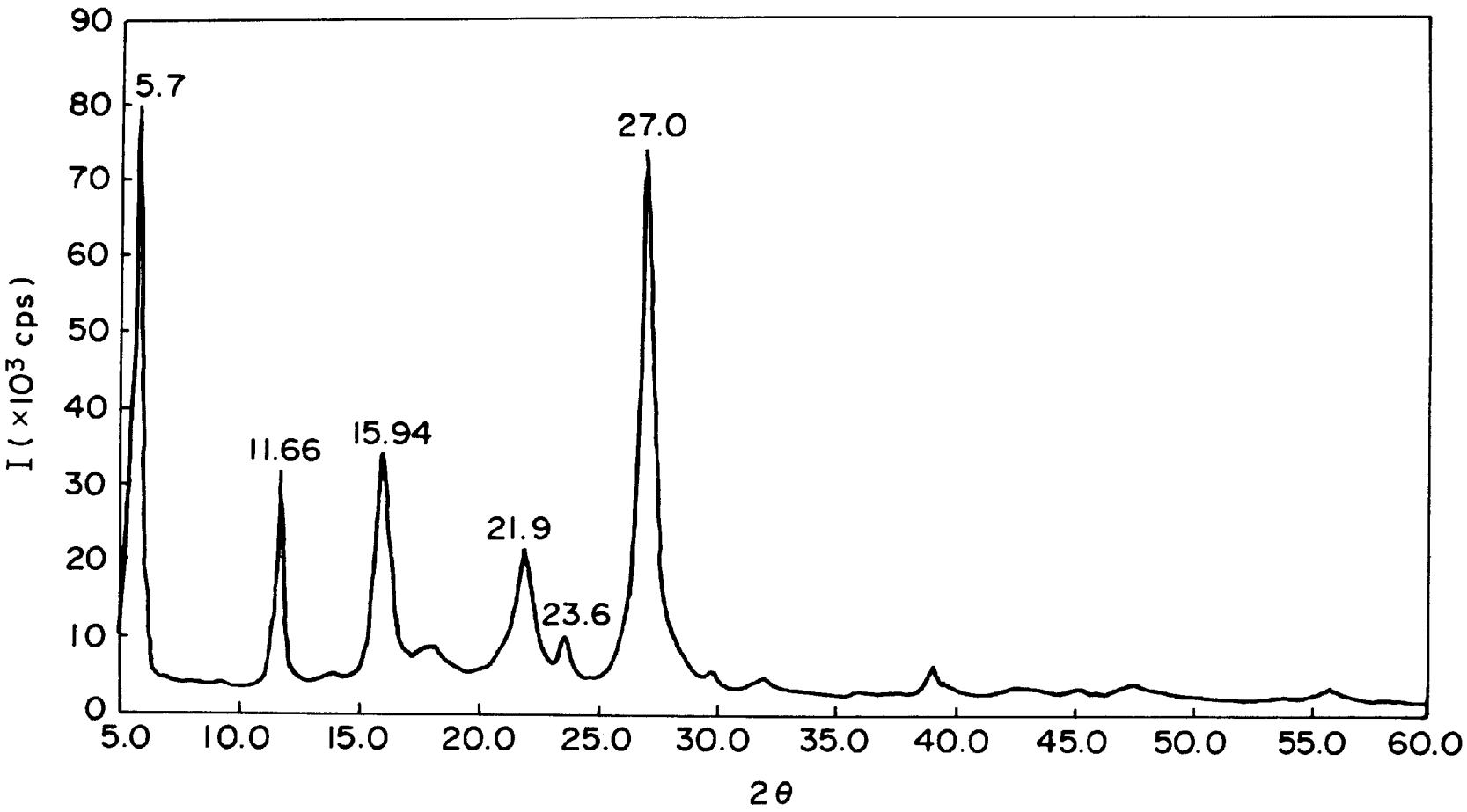
FIG. 5 is an X-ray diffraction spectrum of β-form quinacridone known as a colorant for a magenta toner.

On the other hand, β-form quinacridone and γ-form quinacridone show clearly different X-ray diffraction spectra or peak patterns as shown in FIG. 3 (γ-form) and FIG. 5 (β-form) and exhibit remarkably different hues.

β-form quinacridone is remarkably tinged with violet tint and, compared with β-form, γ-form quinacridone has a hue shifted to a yellowish tint but has a lower coloring power. Accordingly, these forms of quinacridone are used singly, it is impossible to obtain a toner with an objective hue or a toner having a high coloring power.

On the other hand, 2,9-dimethylquinacridone represented by the following structural formula (hereinafter sometimes referrd to a quinacridone (II)

Figure 4:
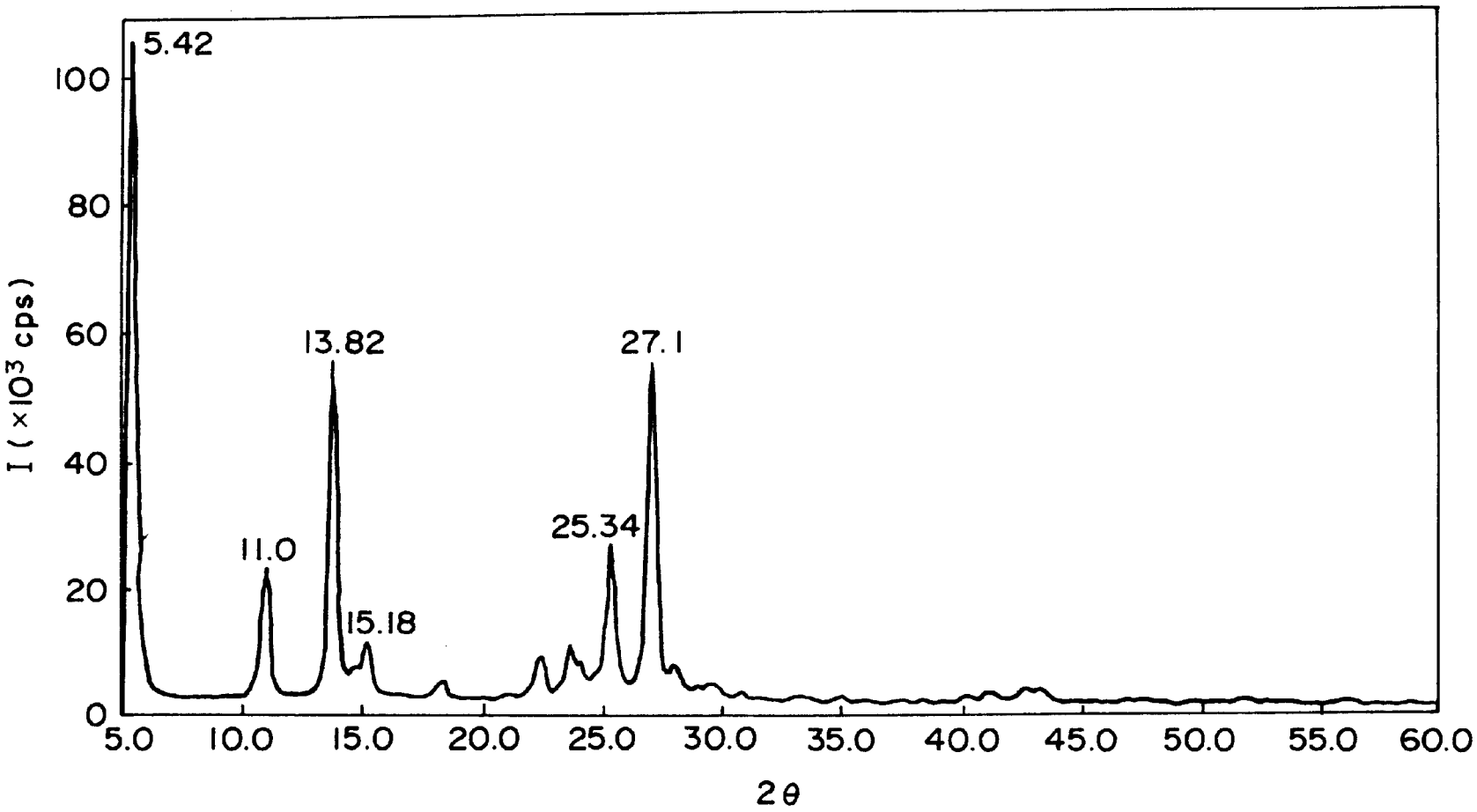

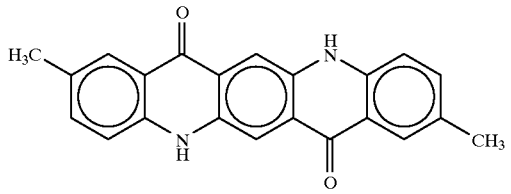

shows an X-ray diffraction spectrum as shown in FIG. 4, presents a clear magenta color and provides a toner having a high coloring power when used as a toner colorant. However, 2,9-quinacridone is characterized by a remarkably bluish tint when compared with magenta hue of a process ink.

A carmine pigment has been widely used as a magenta pigment of process inks but, when used in a toner, shows remarkably poorer light fastness compared with a quinacridone pigment. On the other hand, if a carmine-type red pigment is used in mixture with 2,9-dimethylquinacridone, it is possible to provide a different hue depending on an addition amount thereof. However, a blend of different types of pigments causes a remarkable lowering in clarity, and the resultant toner can hardly realize a high brightness and a high saturation.

As a result of extensive study for providing a magenta toner having an excellent light fastness, a high brightness and a high saturation and a wide color reproducibility, which magenta toner also provides a hue identical to magenta hue of a process ink, we have found it possible to realize the objects by producing a magenta toner under specific process conditions as described below by using γ-form (non-substituted) quinacridone and 2,9-dimethylquinacridone.

More specifically, it is possible to realize the objects by providing a magenta toner containing a quinacridone pigment providing an X-ray diffraction spectrum showing two peaks in a Bragg angle (2θ) region of 5–10 deg.

Figure 1:
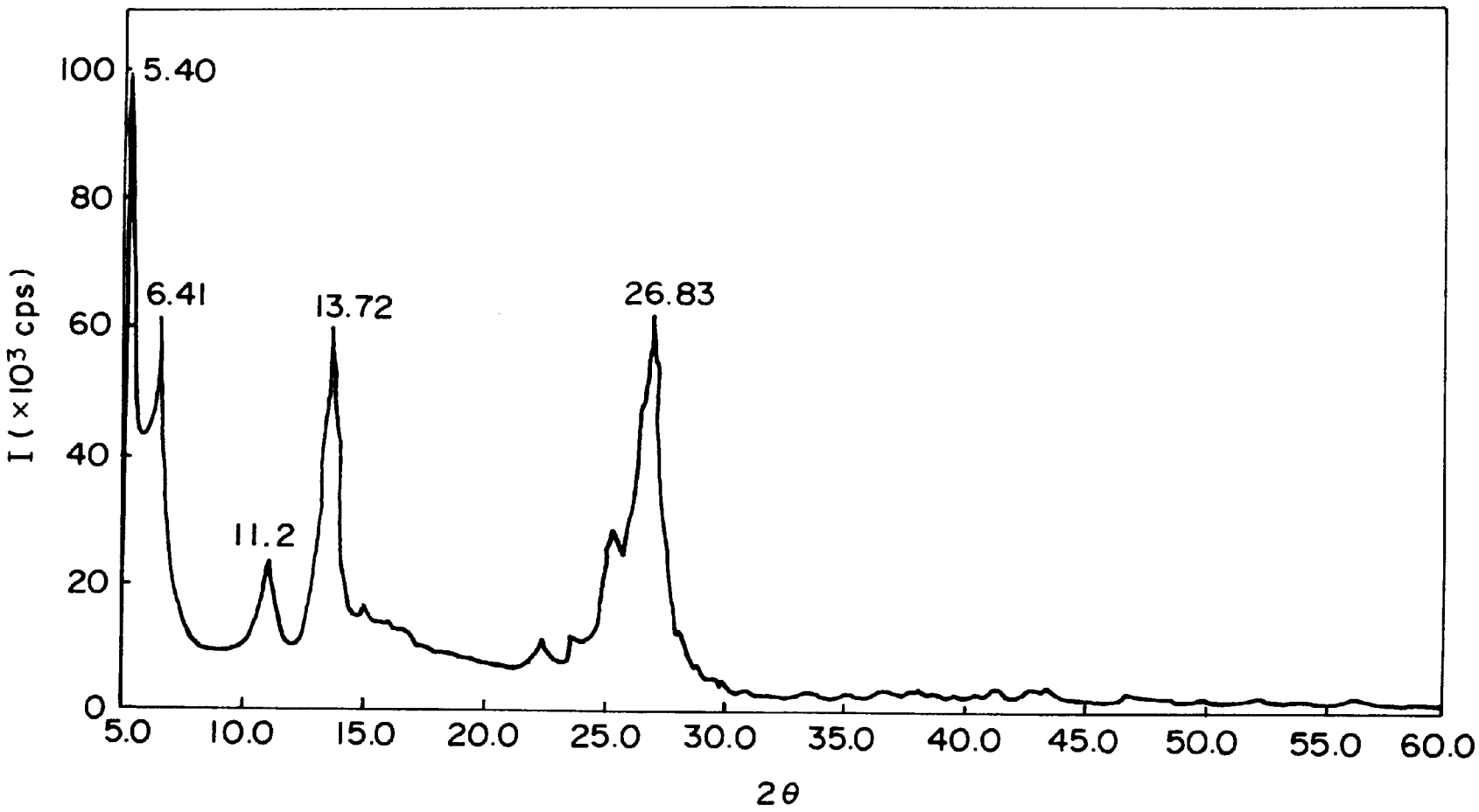
FIG. 1 is an X-ray diffraction spectrum of a magenta colorant contained in a magenta toner prepared in Example 1.
Figure 2:
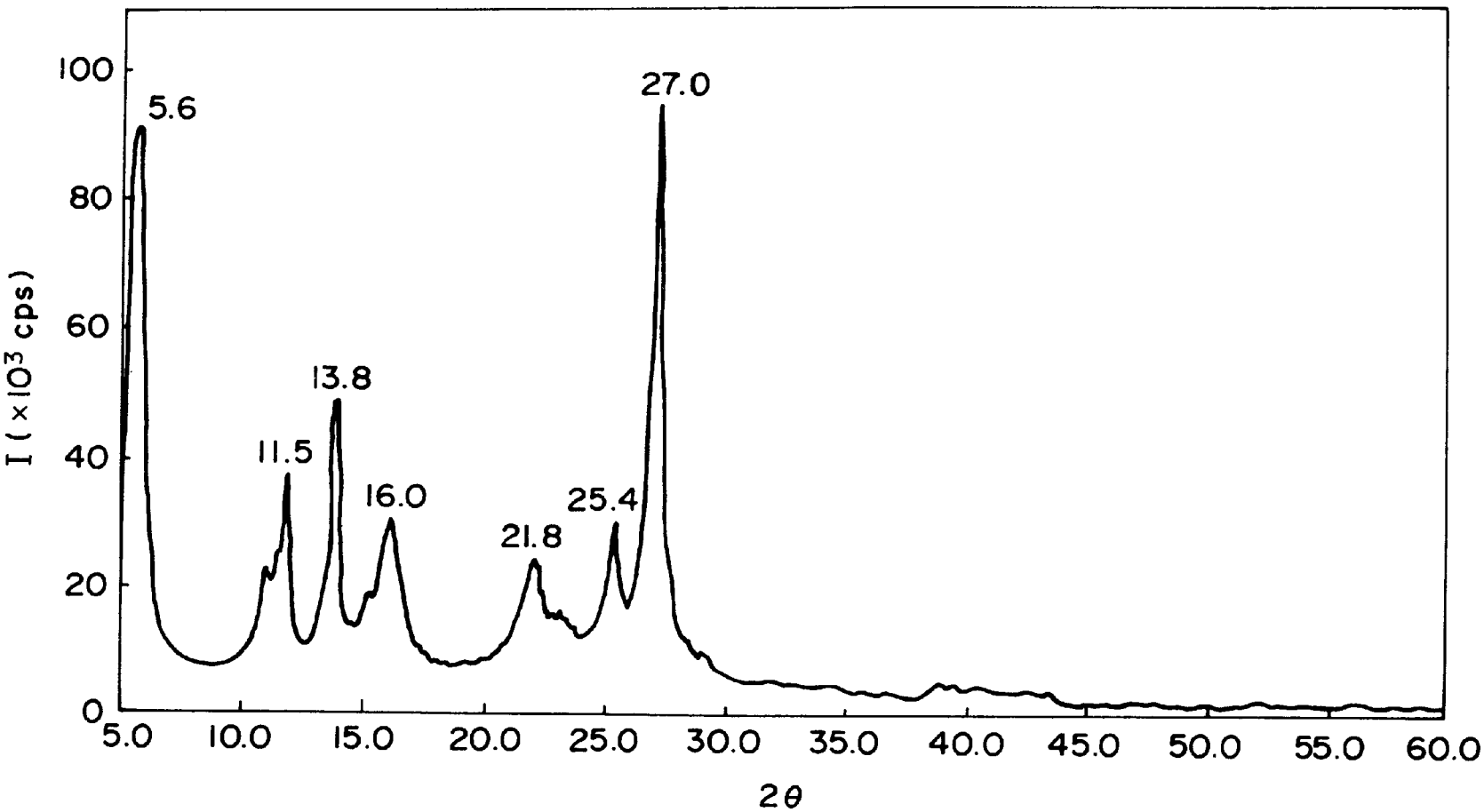
FIG. 2 is an X-ray diffraction spectrum of a magenta colorant contained in a magenta toner prepared in Comparative Example 5.

In an X-ray diffraction spectrum of a pigment in a magenta toner, a Bragg angle 2θ is an important parameter representing a crystal form of the pigment, and the change in diffraction peak position and number of diffraction peaks result in toners having remarkably different hues. More specifically, the presence of two peaks in a Bragg angle (2θ) range of 5–10 deg. (as shown in FIG. 1) means the quinacridone pigment in the magenta toner of the present invention substantially retains γ-form quinacridone (showing an X-ray diffraction spectrum as shown in FIG. 3) and 2,9-dimethylquinacridone (showing an X-ray diffraction spectrum as shown in FIG. 4).

The quinacridone (I) and 2,9-dimethylquinacridone (II) both have a quinacridone skeleton, so that the co-use of these does not cause a lowering in saturation or brightness but allows an objective hue control.

The magenta toner according to the present invention is different from using a mixed crystal of quinacridone (I) and quinacridone (II) but makes use of the characteristics of the respective compounds to the maximum to obtain an objective magenta hue.

Such a mixed crystal of quinacridone (I) and quinacridone (II) only provides an X-ray diffraction spectrum showing a single peak at a Bragg angle (2θ) of 5.6±0.4 deg. and fails to provide an objective hue.

The presence of a single peak in a Bragg angle (2θ) range of 5–10 deg. in an X-ray diffraction spectrum of a magenta colorant in a magenta toner is considered to mean that the toner contains only one of the quinacridone (I) and quinacridone (II) or that, even if it contains two species, the quinacridone (I) does not take the γ-form. This is not sufficient to provide a toner of an objective hue.

The absence of any peak in a Bragg angle (2θ) range of 5–10 deg. in an X-ray diffraction spectrum of a magenta colorant in a magenta toner means that the pigment contained is not of a quinacridone structure, thus failing to provide a toner having a high light fastness, a high brightness and a high saturation.

It is important that the colorant in the magenta toner according to the present invention is highly dispersed. For this reason, the colorant in the toner may preferably have a number-average particle size of at most 0.7 μm, and contain at least 60% by number of particles of 0.1–0.5 μm and at most 10% by number of particles of at least 0.8 μm by controlling the dispersed particle size of the colorant.

More specifically, if the colorant has a number-average particle size exceeding 0.7 μm, this basically means that many of the colorant particles have not been sufficiently dispersed, thus failing to provide a good color reproducibility or a transparency film showing a good transparency. Further, if the colorant particles in the toner are present in an ununiform agglomerate state, the toner particles are caused to have ununiform triboelectric chargeabilities or a broad triboelectric charge distribution, thus failing to provide an objective high-quality full-color image.

It is preferred that the colorant in the toner contains at least 60% by number of particles having particle sizes of 0.1–0.5 μm. This is because the dispersed particle size distribution of the colorant is very important in providing an improved color reproducibility while a great importance has been added to an average particle size when the dispersed particle size of a colorant is discussed.

More specifically, if the dispersed particle sizes of the colorant have a broad distribution, there inevitably results in a remarkable difference in degree of dispersion of the colorant among individual toner particles. As a result, even if the average particle size is lowered, it is impossible to obviate random reflection of light due to relatively large colorant particles not sufficiently dispersed, thus failing to realize objective color reproduction. Particularly, in order to fully utilize the spectral reflection characteristics of colorants in the subtractive color mixing by superposition of three colors of magenta, cyan and yellow, it is desirable to realize as sharp a dispersed particle size distribution as possible.

Colorant particles having minute particle sizes below 0.5 μm are basically not considered to adversely affect the light reflection and absorption characteristics, thus providing good color reproducibility and excellent transparency of a transparency film. On the other hand, if many colorant particles having particle sizes larger than 0.8 μm are present, the brightness and saturation of a projection image are inevitably lowered.

Accordingly, in the present invention, it is preferred that the colorant contains at least 60% by number, more preferably at least 65% by number, further preferably at least 70% by number of particles having particle sizes in the range of 0.1–0.5 μm.

In the present invention, it is preferred that the content of colorant particles of 0.8 μm or larger is at most 10% by number and, basically, the fewer the better. If large colorant particles of 0.8 $\mu$m or larger are present in excess of 10% by number, especially in the vicinity of the surface of toner particles, the liberation thereof from the toner particle surface is inevitable, thus causing various difficulties, such as fog, and soiling and cleaning failure of the drum. Further, in case where such a color toner is used to constitute a two-component type developer, the problem of carrier soiling is caused, thus failing to provide stable images over a long period of continuous image formation. It becomes difficult to effect good color reproduction and obtain a uniform chargeability.

A magenta toner produced by using quinacridone (I) and quinacridone (II) does not always satisfy the X-ray diffraction spectrum requirement of the quinacridone pigment in the magenta toner according to the present invention that it shows two peaks in a Bragg angle (2θ) range of 5–10 deg.

The quinacridone (I) having a γ-form crystal structure used in the present invention is transformed into a β-form crystal structure when subjected to a strong mechanical stress (i.e., load) so that it is necessary to ensure that the quinacridone pigment is not subjected to a strong mechanical stress during the production process of the magenta toner.

However, as the magenta toner according to the present invention uses two types of quinacridone compounds (I) and (II) so that these compounds have to be sufficiently mixed with each other. Further, the quinacridone compounds have to be sufficiently dispersed in the magenta toner so that the magenta toner provides a good hue in combination with other color toners and good light transmittance of a projection image obtained through a color image formed on an OHP sheet.

Accordingly, it is impossible to obtain a magenta toner containing the two quinacridone compounds (I) and (II) in a well mixed and dispersed state by simply adopting mild mixing and kneading conditions in the toner production process so as to reduce a mechanical stress applied during the toner production.

In the present invention, it is possible to obtain a magenta toner containing a quinacridone pigment providing an X-ray diffraction spectrum showing two peaks in a Bragg angle (2θ) range of 5–10 deg. by using γ-form quinacridone (I) and quinacridone (II) for preparation of a toner, e.g., under specific conditions descried hereinafter.

In the present invention, quinacridones (I) and (II) may be blended in a weight ratio in a range of 10:90–90:10, preferably 20:80–70:30, further preferably 30:70–60:40.

If quinacridone (I) is below 10 wt. % in the colorant mixture, it is possible to provide a toner with a high coloring power, but it is insufficient to effect a hue control as another object of the present invention, to result in a large hue difference from magenta color of a process ink. On the other hand, if quinacridone (I) is more than 90 wt. %, the resultant toner is caused to have a lower coloring power, so that it becomes difficult to provide a high image density output. Moreover, the hue is excessively shifted to a yellowish side. As described above, in a full-color image formation, color reproduction is performed by using three primary color toners of yellow, magenta and cyan, or four color toners including a black toner in addition thereto, so that the reproducibility of a blue-type color obtainable by substractive color mixing with cyan is remarkably lowered if the magenta color is remarkably shifted to a yellow side.

In the magenta toner according to the present invention, the mixture of quinacridone (I) and quinacridone (II) may preferably be contained in an amount of 2–15 wt. parts, more preferably 2.5–12 wt. parts, further preferably 3–10 wt. parts, respectively per 100 wt. parts of the binder resin.

If the total content of quinacridone (I) and quinacridone (II) is less than 2 wt. parts, the coloring power of the resultant toner is lowered, so that it becomes difficult to obtain a high-quality image at a high image density even if the dispersion of the pigment is improved to the best. Above 15 wt. parts, the resultant toner is caused to have a lower transparency, thus failing to provide a good OHP transparency. Moreover, the reproducibility of a halftone as represented by a human skin color is lowered. Further, the chargeability of the resultant toner becomes unstable to result in difficulties, such as the occurrence of fog in a low temperature—low humidity environment, an toner scattering in a high temperature—high humidity environment.

The thus-obtained magenta toner is provided with an excellent light fastness and found to cause little color change when an image sample obtained therefrom is subjected to a long period of exposure test performed in a manner substantially according to JIS K7102 by using a commercially available weather meter.

A color change may be quantitatively evaluated in terms of ΔE defined by the following equation based on the CIE 1976 L*a*b*-color space:

$$\Delta E=\{(L1^*-L2^*)^2+(a1^*-a2^*)^2+(b1^*-b2^*)^2\}^{1/2},$$

wherein L1*, a1* and b1* denote three color indices before the exposure, and L2*, a2* and b2* denote three color indices after the exposure. A smaller value of ΔE represents a smaller degree of color change or color fading.

The binder resin constituting the magenta toner according to the present invention may comprise various resins which have been used as binder resins for electrophotographic toners.

Examples thereof may include: polystyrene, styrene copolymers such as styrene-butadiene.copolymer and styrene-acrylic copolymers, polyethylene, ethylene-vinyl acetate copolymer, phenolic resin, epoxy resin, allyl phthalate resin, polyamide resin, polyester resin, and maleic acid resin. In the present invention, a toner having a good pigment dispersion and a stable chargeability can be obtained especially when a polyester resin is used as a binder resin combination with quinacridones (I) and (II).

More specifically, a toner obtained by using a polyester resin in combination with quinacridones (I) and (II) exhibits remarkable effects in preventing an excessive charge in a low temperature—low umidity environment and suppressing a lowering in hargeability in a high temperature—high humidity nvironment.

The reason for the above effects has not been fully clarified as yet, but the improvements may be attributable to an enhanced mutual solubility between the polyester binder resin and the quinacridone pigment owing to a partial hydrogen bond and/or an electrostatic bond between the carboxyl or hydroxy group at polyester terminals and the imino group or carbonyl group in the quinacridone skeleton, resulting in an improved dispersibility of the colorant and a stable chargeability.

According to our further study, 2,9-dimethylquinacridone (II) exhibits a higher positive chargeability than quinacridone (I) and therefore exhibits a better effect of preventing excessive charge of a negatively chargeable toner comprising a polyester resin in a low temperature—low humidity environment than in the case of using quinacridone (I) alone.

The suppression of a chargeability lowering in a high temperature—high humidity environment may be attributable to a good pigment dispersibility as discussed above, which is assumed to promote the blocking by the pigment of water adsorption onto the terminal functional groups of the binder resin, thus providing a stably high chargeability even in a high temperature—high humidity environment.

As a result, it is possible to provide fog-free high-quality images of stable image densities in a long period of continuous image formation when a polyester resin is used as a binder resin.

It is particularly preferred to use a polyester resin formed by polycondensation of a bisphenol derivative of the following formula (III):

(III)

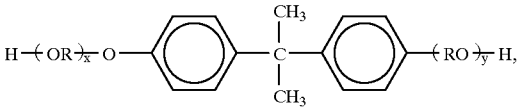

wherein R denotes an ethylene or propylene group, x and y are independently an integer of at least 1 with the proviso that the average of x+y is in the range of 2–10, or a substitution derivative thereof, as a diol component, with a carboxylic acid component selected from polycarboxylic acids having at least two carboxylic groups and their anhydrides and lower alkyl esters, such as fumaric acid, maleic acid, maleic anhydride, phthalic acid, terephthalic acid, trimellitic acid and pyromellitic acid.

The polyester resin may preferably have an acid value of 2–25 mgKOH/g, more preferably 3–22 mgKOH/g, further preferably 5–20 mgKOH/g so as to provide a toner showing stable chargeability in various environmental conditions.

If the acid value is below 2 mgKOH/g, the resultant toner is liable to cause a charge-up (i.e., have an excessive charge), thereby resulting in a lower image density, in a low temperature—low humidity environment. If the acid value is larger than 25 mgKOH/g, the resultant toner is liable to have an unstable chargeability with time, thus showing a tendency of chargeability lowering with continuation of image formation, and is liable to result in image defects such as toner scattering and fog particularly in a high temperature—high humidity environment.

In view of the storability of the resultant toner, the polyester resin may preferably have a glass transition temperature of 50–75° C., more preferably 52–65° C.

In case where the glass transition temperature of the polyester resin is below 50° C., the resultant toner may be provided with a good fixability but is liable to have a lower anti-offset characteristic, soil the fixing roller and cause paper winding about the fixing roller. Further, the fixed toner image is liable to have an excessively high surface gloss, thus lowering the image quality.

In case where the glass transition temperature of the polyester resin is higher than 75° C., the resultant toner is caused to have a poor fixability, requires a higher fixing temperature, is liable to provide images with a low gloss and has a lower color-mixability for full-color image formation.

The polyester resin may preferably have a number-average molecular weight (Mn) of $1.5\times10^3$–$5\times10^4$, more preferably $2\times10^3$–$2\times10^4$, a weight-average molecular weight (Mw) of $6\times10^3$–$10^5$, more preferably $8\times10^3$–$9\times10^4$, and an Mw/Mn ratio of 2–8. A toner comprising a polyester resin satisfying a molecular weight distribution as represented by the above-mentioned conditions may have a god thermal fixability, an improved dispersibility of the colorant therein and little fluctuation in chargeability, and provides an improved reliability of image quality.

In the case where the polyester resin has a number-average molecular weight (Mn) below $1.5\times10^3$, or a weight-average molecular weight (Mw) below $6\times10^3$, the resultant toner provides a fixed image which has a high surface smoothness and is apparently clear, but is liable to result in offset during continuous image formation, have a low storage stability and cause difficulties, such as toner melt-sticking and occurrence of spent carrier in the developing apparatus. Further, as it becomes difficult to apply a shearing force during toner production, the resultant toner is liable to have a lower dispersibility of the colorant, a lower coloring force and an unstable chargeability.

In case where the polyester resin has a number-average molecular weight (Mn) exceeding $5\times10^4$ or a weight-average molecular weight (Mw) exceeding $10^5$, the resultant toner may have an excellent antioffset characteristic, but requires a high fixing temperature and is liable to provide an image with a lower surface smoothness and a lower color reproducibility, even if the pigment dispersion can be adequately controlled.

In case where the polyester resin has an Mw/Mn ratio below 2, the polyester resin is generally liable to have also a low molecular weight so that, similarly as in the above-mentioned case of a small molecular weight, the resultant toner is liable to cause difficulties, such as offset phenomenon during continuous image formation, a lowering in storage stability, occurrence of toner sticking and spent carrier in the developing device and unstable toner chargeability.

In case where the polyester resin has an Mw/Mn ratio exceeding 8, the resultant toner may have an excellent anti-offset characteristic but requires an inevitably high fixing temperature and results in images having a lower surface smoothness and a lower color reproducibility even if the pigment dispersion can be adequately controlled.

Next, a preferred process for producing the magenta toner according to the present invention will be described.

In the present invention, in order to produce a magenta toner containing a quinacridone pigment providing a characteristic X-ray diffraction spectrum as described above, it is preferred to adopt a process, wherein (i) a first binder resin, a first paste pigment comprising a first dispersion medium and 5–50 wt. % of particles of quinacridone (I) insoluble in the first dispersion medium, and a second paste pigment comprising a second dispersion medium and 5–50 wt. % of particles of 2,9-dimethylquinacridone (II) insoluble in the second dispersion medium, are charged in a kneader or a blender and blended therein with each other under heating and under no pressure application to melt the first binder resin; (ii) further the quinacridone (I) and quinacridone (II) in the first and second paste pigments are caused to migrate or be partitioned into the heated first binder resin, i.e., a meted resin phase; (iii) the first binder resin, the quinacridone (I) and the quinacridone (II) are melt-kneaded; (iv) the liquid (i.e., the first and second dispersion media) is evaporated off for drying to provide a first kneaded product; (v) a second binder resin and other additives, such as a charge control agent, as desired, are added to the first kneaded product, and the resultant mixture is melt-kneaded under heating to provide a second kneaded product; and (vi) the second kneaded product is cooled for solidification, pulverized and classified to provide magenta toner particles.

In the above-described process, the first binder resin and the second binder resin may be identical to or different from each other. The first dispersion medium and the second dispersion medium may be identical to or different from each other but may commonly comprise water in ordinary cases.

In the above, the term "paste" in the first and second paste pigments refers to a state that the pigment particles therein (i.e., particles of quinacridone (I) or quinacridone (II)) are present therein without experiencing any drying step. In other words, it refers to a state wherein the pigment particles are dispersed in their substantially primary particle state in a proportion of 5–50 wt. % of the total paste. The remainder of the paste is occupied by a major proportion of volatile liquid (i.e., a dispersion medium), and some proportion of a dispersing agent and optional additive. The volatile liquid (dispersion medium) can be basically any liquid which is evaporatable by ordinary heating and does not substantially dissolve the pigment, but may preferably comprise water as described above from an ecological viewpoint and other viewpoints.

In the present invention, quinacridone (I) and quinacridone (II) are used in the farm of (pigment) particles insoluble in a volatile liquid dispersion medium concerned and dispersed therein. Typically, they are present as water-insoluble particles in the case where water is used as the dispersion medium.

In the above-described first and second paste pigments, the pigment particles of quinacridone (I) and quinacridone (II) may respectively be contained in a proportion of 5–50 wt. %, preferably 5–45 wt. %. If the pigment particles are contained in excess of 50 wt. %, the efficiency of migration or partition thereof into the binder resin becomes low so that a high kneading temperature and/or a long kneading time is required. Moreover, a powerful screw or paddle mechanism may be required in the kneading apparatus, thus being liable to cause undesirable polymer chain severance.

On the other hand, if the pigment particles are contained in less than 5 wt. % as a solid in the first or second paste pigment, a large amount of the paste pigment has to be charged in order to obtain an objective pigment content, so that a large size of the kneading apparatus has to be used. Further, in the case of below 5 wt. %, the water (dispersion medium) removal capacity has to be enhanced after the first kneading step, and the complete kneading step, and the complete water removal applies a serious load onto the binder resin.

In the step of blending or kneading the first and second paste pigments and the first binder resin, the total of quinacridone (I) and quinacridone (II) as solid pigment in the first and second paste pigments and the first binder resin may preferably be present in a weight ratio of 10:90–50:50, more preferably 15:85–45:55.

If the solid-basis total pigment content in the pigment-resin mixture is below 10 wt. %, a large amount of the first binder resin relative to the first and second paste pigments has to be charged in the kneading apparatus, so that the localization of the pigment particles (of quinacridones (I) and (II)) is liable to occur, and a long kneading time is required until a uniform blend is obtained, thus applying an excessive load onto the binder resin and failing to attain objective resin properties.

If the total pigment content in the pigmentfirst binder resin mixture is in excess of 50 wt. %, the migration or partitioning of the pigment particles of quinacridones (I) and (II) into the first binder resin cannot be smoothly effected and, also in the kneading step after the migration of the quinacridone particles, it becomes difficult to obtain a uniform molten state of the kneaded product, thus failing to obtain a well dispersed state.

In the above-described process, the melt-kneading is performed under no pressure application. This is because, if the melt-kneading is performed under pressure, the liquid dispersion medium (i.e., water) in the first and second paste pigments can vigorously attack the first binder resin, particularly cause a partial hydrolysis when the first binder resin is a polyester resin or denaturation of another binder resin, thus resulting in remarkable change of binder resin properties, e.g., a remarkably worse anti-offset characteristic. Accordingly, in the above-described process, the melt-kneading of the first binder resin and the first and second paste pigments is preferably performed under no pressure.

The kneading apparatus used in the first kneading step of the above process may comprise a heating kneader, a single-screw extruder, a twin-screw extruder or a kneader. A heating kneader is particularly preferred.

The first kneaded product obtained by the above-mentioned first kneading step and containing uniformly dispersed colorant (quinacridone pigment) is blended with the second binder resin, and the blend is subjected to a second kneading.

In the second kneading step, other toner components, such as a charge control agent and a wax, may be blended together with the first kneaded product and the second binder resin to obtain a second blend, which may be further kneaded to provide a second kneaded product.

In order to attain an effective dispersion of a colorant in a binder resin, it is generally preferred to apply a strong shearing force to the colorant in the binder resin at a high colorant concentration. However, application of such a high shearing force to γ-form quinacridone (I) can cause crystal structure change thereof especially when it is co-present with 2,9-quinacridone. Accordingly, in the preferred process of the present invention, quinacridone (I) and quinacridone (II) are supplied in their paste states retaining a good dispersion state and blended or kneaded with the binder resin in a wet state at least in the initial stage of the first kneading step to effect a good dispersion of the colorant while alleviating a crystal transformation in a high pigment concentration state. Thus, the initially wet first kneading step allows a good compromise between a good dispersion and prevention of an undesirable crystal structure change of the quinacridone pigment. Two step kneading process preferably adopted in the present invention is advantageous for allowing such an initially wet first kneading step.

After attaining a good dispersion state of the quinacridone pigment in the first binder resin, the resultant first kneaded product (master batch) is blended and diluted with the second binder resin in an amount sufficient to provide a final colorant concentration of, e.g., 2–15 wt. %, and also with other additives such as a charge control agent and a wax. The addition of these additives in the second kneading step is desirable, e.g., in order to minimize the deterioration of the additives, such as the charge control agent and obviate an unnecessary lowering in shearing force adversely affecting the colorant dispersion at a high pigment concentration state in the first kneading step.

The kneading apparatus used in the second kneading step may be identical or similar to those used in the first step.

The second kneaded product thus obtained through the second kneading step may be, after cooling, pulverized and classified according to known manners to provide a magenta toner according to the present invention.

The magenta toner according to the present invention can also be produced without using paste pigments as described above in the following manner.

That is, powdery pigment-form quinacridone (I) and quinacridone (II) and a first binder resin-may be charged in a kneader-type mixer, blended therein and further heated under no pressure application while continuing the blending, to effect a sufficient pre-blending. Thereafter, the pre-blend may be kneaded two or more times by a kneader, such as a three-roll mill to obtain a first kneaded product.

In the blending or kneading, the total of the quinacridone (I) and (II) and the first binder resin may preferably be used in a weight ratio of 10:90–50:50, preferably 15:85–45:55.

As described above, the magenta toner according to the present invention can also be prepared by using powdery pigment-form quinacridone (I) and quinacridone (II). However, it is preferred to prepare the magenta toner by using the paste pigment rather than the dry-powdery pigments so as to realize good dispersion of the quinacridone pigment in the magenta toner and avoid an application of a strong load or mechanical force onto the quinacridone pigment during the magenta toner production, thereby obviating a crystal structure change of γ-form quinacridone (I).

The magenta toner according to the present invention can be constituted as a negatively chargeable toner or a positively chargeable toner. However, in case where a polyester resin having a high negative chargeability is used in combination with the quinacridone (I) and quinacridone (II), the magenta toner may provide a negatively chargeable toner having a highly stabilized chargeability and capable of realizing stabilization of high image quality and improved continuous image forming performance.

The magenta toner according to the present invention can further contain a charge control agent as desired. It is particularly preferred to incorporate as a negative charge control agent an organometallic compound, examples of which may include metal compounds of aromatic carboxylic acid derivatives, such as chromium compound, aluminum compound and zinc compound of di-tert-butylsalicylic acid, so as to further stabilize the chargeability of the magenta toner according to the present invention.

Such a charge control agent may be suitably contained in a proportion of 3–10 wt. %, preferably 4–8 wt. %, of the magenta toner. If the charge control agent is used in the above-described range of amount, it is possible to easily obtain an absolute chargeability required for development with little initial chargeability change, so that it is possible to obviate a lowering in image quality, due to fog or a lower image density. However, the above-mentioned range of amount is not absolutely restrictive as far as an amount outside the range does not adversely affect the hue of the magenta toner.

It is also possible to add as a lubricant an aliphatic acid metal salt, such as zinc stearate, or aluminum stearate, or fine powder of a fluorine-containing polymer, such as polytetrafluoroethylene, polyvinylidene fluoride, or tetrafluoroethylenevinylidene fluoride copolymer; or an electroconductivity-imparting agent, such as tin oxide or zinc oxide, as desired.

It is sometimes preferred to also incorporate a release agent as a fixing aid. Examples thereof may include: aliphatic hydrocarbon waxes and oxidized products thereof, waxes consisting principally of aliphatic acid esters, saturated linear aliphatic acids, unsaturated aliphatic acids, saturated alcohols, polyhydric alcohols, aliphatic acid amides, saturated aliphatic acid bisamides, unsaturated aliphatic acid amides, and aromatic bisamides. The release agent may be contained in 0.1–20 wt. parts, preferably 0.5–10 wt. parts, per 100 wt. parts of the binder resin. A release agent amount exceeding 20 wt. parts is liable to provide a toner with inferior anti-blocking characteristic or inferior anti-offset property. Below 0.1 wt. part, the release effect may be scarce.

The release agent may preferably be incorporated in the binder resin by a method of dissolving the resin in a solvent and adding the release agent into the resin solution under stirring at an elevated temperature, or by a method of adding the release agent at the time of kneading the binder resin.

It is also preferred to add to the toner a flowability improving agent which can increase the flowability of the toner by the addition. Examples of the flowability improving agent may include: fine powders of metal oxides, such as silica, alumina, titanium oxide, zirconium oxide and magnesium oxide; fine powders of nitrides, such as boron nitride, aluminum nitride and carbon nitride; an fine particles of resins, such as silicone resin.

In the present invention, it is preferred to add a member selected from the group consisting of calcium titanate, strontium titanate, barium titanate, magnesium titanate, cerium oxide, zirconium oxide, aluminum oxide, titanium oxide, zinc oxide, and calcium carbonate. It is particularly preferred to use hydrophobized (i.e., hydrophobicity-imparted) titanium oxide fine powder or aluminum oxide fine powder having an average primary particle size of 0.01–0.2 μm.

The additive is required not to hinder the chargeability of the toner in addition to improving the toner flowability. Accordingly, it is preferred that the flowability-imparting agent has been surface-hydrophobized so as to satisfy the flowability improvement and the charge stabilization in combination.

More specifically, as a result of the hydrophobization treatment, the adverse effect of moisture as a factor of changing the chargeability may be removed to minimize a difference in chargeability in a high humidity environment and a low humidity environment, thereby improving an environmental stability, an it becomes possible to prevent agglomeration of the primary particles thereof in the toner, thus allowing a uniform charge of the toner.

In the present invention, particularly by using titanium oxide or aluminum oxide fine powder having average primary particle size of 0.01–0.2 μm, it becomes possible to provide the toner with good flowability and uniform chargeability, thereby effectively preventing the occurrence of toner scattering and fog. Further, as the fine powder is not readily embedded at the toner particle surface, so that the toner deterioration is not readily caused, thereby providing an improved continuous image formation characteristic on a large number of sheets. This tendency is particularly noticeable when the magenta toner according to the present invention is constituted as a sharp-melting toner.

When combined with the magenta toner (particles) according to the present invention, the flowability improving agent fine powder may preferably be added in an amount of 0.5–5.0 wt. %, more preferably 0.7–3.0 wt. %, further preferably 1.0–2.5 wt. %. By satisfying the range, it is possible to provide the toner with a good flowability and a stable chargeability while effectively suppressing the toner scattering.

The magenta toner according to the present invention thus-prepared may preferably have a weight-average particle size of 3–10 μm, more preferably 4–9 μm.

In case where the toner according to the present invention is used as a two-component type developer, the toner may be mixed with a carrier, examples of which may include: surface-oxidized or -non-oxidized particles of magnetic metals, such as iron, nickel, copper, zinc, cobalt, manganese, chromium and rare-earth metals, and magnetic alloys, magnetic oxides and magnetic ferrites of these metals.

A coated carrier comprising carrier core particles coated with a coating material may be prepared by coating the carrier core with a solution or dispersion of a coating material, such as a resin, or by simple powder blending.

The coating material attached onto the carrier core surface may be different depending on a toner material used in combination therewith but may for example comprise one or more species selected from polytetrafluoroethylene, monochlorotrifluoroethylene polymer, polyvinylidene fluoride, silicone resin, polyester resin di-tert-butylsalicylic acid metal complexes, styrene-resin, acrylic resin, polyamides, polyvinylbutyral, nigrosine, aminoacrylate resin, basic dies and laked products thereof, silica fine powder and alumina fine powder. These are however not exhaustive.

The coating amount may be determined appropriately but may preferably be in a proportion of 0.1–30 wt. %, more preferably 0.5–20 wt. %, in total, of the carrier.

The carrier may preferably have an average particle size of 10–100 μm, more preferably 20–70 μm.

In a preferred mode, the carrier may comprise a magnetic ferrite carrier surface-coated with (i) a silicone resin or (ii) a combination of a fluorine-containing resin and a styrene resin. Preferred examples of the combination of the fluorine-containing resin and the styrene resin may include: polyvinylidene fluoride and styrene-methyl methacrylate resin, polytetrafluoroethylene and styrene-methyl methacrylate resin, and a fluorine-containing copolymer and a styrene copolymer. The fluorine-containing resin and the styrene resin may preferably be mixed in a weight ratio of 90:10 20:80, more preferably 70:30–30:70. It is particularly preferred to use a coated ferrite carrier having a coating rate of 0.01–5 wt. %, more preferably 0.1–1 wt. % and having an average particle size in the above-described range in addition to a particle size distribution including carrier particles of 250 mesh-pass and 400 mesh-on. Examples of the fluorine-containing copolymer may include vinylidene fluoride-tetrafluoroethylene copolymer (copolymerization wt. ratio=10:90–90:10), and examples of the styrene copolymer may include: styrene-2-ethylhexyl acrylate copolymer (wt. ratio=20:80–80:20), and styrene-2-ethylhexyl acrylate-methyl methacrylate copolymer (wt. ratio=20–60:5–30:10–50).

The above-mentioned coated magnetic ferrite carrier having a sharp particle size distribution as described above may provide a preferred triboelectric charge to and improved electrophotographic performances to the magenta toner according to the present invention.

In order to provide a generally good performance in the case of constituting a two-component type developer, the magenta toner according to the present invention may be blended with the carrier so as to provide a toner concentration in the developer of 2–15 wt. %, preferably 3–13 wt. %, more preferably 4–10 wt. %. If the toner concentration is below 2 wt. %, the image density is liable to be lowered and, in excess of 15 wt. %, the toner is liable to result in fog, cause scattering in the apparatus and lower the life of the developer.

[Crystal structure analysis]

Crystal structure analysis for characterizing the present invention may be performed in the following manner.

(1) For X-ray diffraction analysis of a colorant in a toner, a sample magenta toner is washed within water containing a surfactant under application of ultrasonic vibration to remove the external additive, and the resultant magenta toner particles are dissolved in THF (tetrahyrofuran) or chloroform to be separated into a soluble matter and an insoluble matter by using a Soxhlet extractor. Then, and the recovered insoluble matter is sufficiently dried and then left standing for at least 24 hours in an environment of 23° C./60%RH to be used as a measurement sample.

In the case where the sample magenta toner contains a THF- or chloroform-insoluble charge control agent, the measurement sample recovered contains the charge control agent, so that the resultant X-ray diffraction spectrum can include a diffraction pattern attributable to the charge control agent. Accordingly, the charge control agent alone is separately subjected to X-ray diffraction analysis to confirm the X-ray diffraction pattern thereof in advance. Then, if the charge control agent provides a peak in a Bragg angle (2θ) range of 5–10 deg., the peak is removed from the diffraction pattern in the X-ray diffraction spectrum of the measurement ample to evaluate peaks in the Bragg angle (2θ) range of 5–10 deg. attributable to the colorant in the measurement sample.

(2) For X-ray diffraction analysis of a colorant or a charge control agent alone, a sample is left standing for at least 24 hours in an environment of 23° C./60%RH and then used as a measurement sample.

Each measurement sample is subjected to X-ray diffraction analysis by using Kα rays of Cu-characteristic X-rays to obtain an X-ray diffraction spectrum including a diffraction pattern versus Bragg angle (2θ). The apparatus may for example be a powerful automatic X-ray diffraction apparatus ("MXP[18]", available from Mac Science K.K.), but this is not restrictive. In the present invention, a peak in the Bragg angle (2θ) range of 5–10 deg. is judged to be present if it shows an S/N ratio (signal/noise ratio) of at least 4.

For example, FIGS. 3, 4 and 5 show X-ray diffraction spectra of γ-form quinacridone (I), 2,9-dimethylquinacridone (II) and β-form quinacridone (I), respectively.

In the Bragg angle (2θ) range of 5–10 deg., β-form quinacridone (I) provides a peak at 5.7±0.3 deg. (FIG. 5); γ-form quinacridone (I) provides a peak at 6.3±0.3 deg. (FIG. 3); and 2,9-dimethylquinacridone (II) provides a peak at 5.4±0.3 deg., which are all clearly observable peaks.

[Average particle size (Dav.) of colorant]

A toner sample is dispersed in a 2.3 M-sucrose solution under sufficient stirring, and a small amount of the dispersion is applied onto a sample holder pin, dipped in liquid $N_2$ to be solidified and then immediately set onto a sample arm head. Then the solidified sample is sliced by an ultramicrotome equipped with a cryostat ("FC4E", available from Nissei Sangyo K.K.) in an ordinary manner to obtain an electron microscope sample.

The sample is then observed and photographed through an electron microscope ("H-8000", available from Hitachi Seisakusho K.K.) at an acceleration voltage of 100 kV. The magnification of the photograph is selected appropriately depending on the sample.

The image data of the thus-taken photograph(s) is introduced via an interface into an image analyzer ("Luzex 3", available from Nicore K.K.) to be converted into binary image data, among which up to 300 pigment particles having particle sizes of at least 0.1 μm are sampled at random and are analyzed to obtain a number-average particle size and a particle size distribution of sample pigment particles.

As described above, only particles having a particle size of at least 0.1 μm are sampled as measurement objects, and the particle size herein refers to a diameter of an approximated sphere (or circle) of a pigment particle image.

Toner particle size distribution

The particle size distribution of a toner sample may be measured by using a Coulter counter TA-II or Coulter Multisizer (available from Coulter Electronics Inc.).

For measurement, a 1%-NaCl aqueous solution (e.g., ISOTON R-II (available from Coulter Scientific Japan K.K.)) as an electrolytic solution is prepared by using a reagent-grade sodium chloride. Into 100 to 150 ml of the electrolytic solution, 0.1 to 5 ml of a surfactant, preferably an alkylbenzenesulfonic acid salt, is added as a dispersant, and 2 to 20 mg of a sample is added thereto. The resultant dispersion of the sample in the electrolytic liquid is subjected to a dispersion treatment for about 1–3 minutes by means of an ultrasonic disperser, and then subjected to measurement of particle size distribution in the range of 2–40.3 μm (13 channels) by using the above-mentioned Coulter counter with a 100 μm-aperture to obtain a volume-basis distribution and a number-basis distribution. From the results of the volume-basis distribution and number-basis distribution, parameters characterizing a toner may be obtained. More specifically, the weight-basis average particle size ($D_4$) or volume-average particle size (Dv) may be obtained from the volume-basis distribution while a central value in each channel is taken as a representative value for each channel.

The above-mentioned 13 channels includes 2.00–2.52 μm; 2.52–3.17 μm; 3.17–4.00 μm; 4.00–5.04 μm; 5.04–6.35 μm; 6.35–8.00 μm; 8.00–10.08 μm; 10.08–12.70 μm; 12.70–16.00 μm; 16.00–20.20 μm; 20.00–25.40 μm: 25.40–32.00 μm; and 32.00–40.30 μm.

Next, a color image forming method according to the present invention will now be described.

In the color image forming method according to the present invention, a magenta toner and at least one color toner selected from a cyan toner and a yellow toner are used in combination to form a color toner image on a recording material, and the color toner image is fixed under heating onto the recording material to form a color image, wherein the magenta toner is a magenta toner comprising a quinacridone pigment showing a characteristic X-ray diffraction spectrum.

Figure 6:
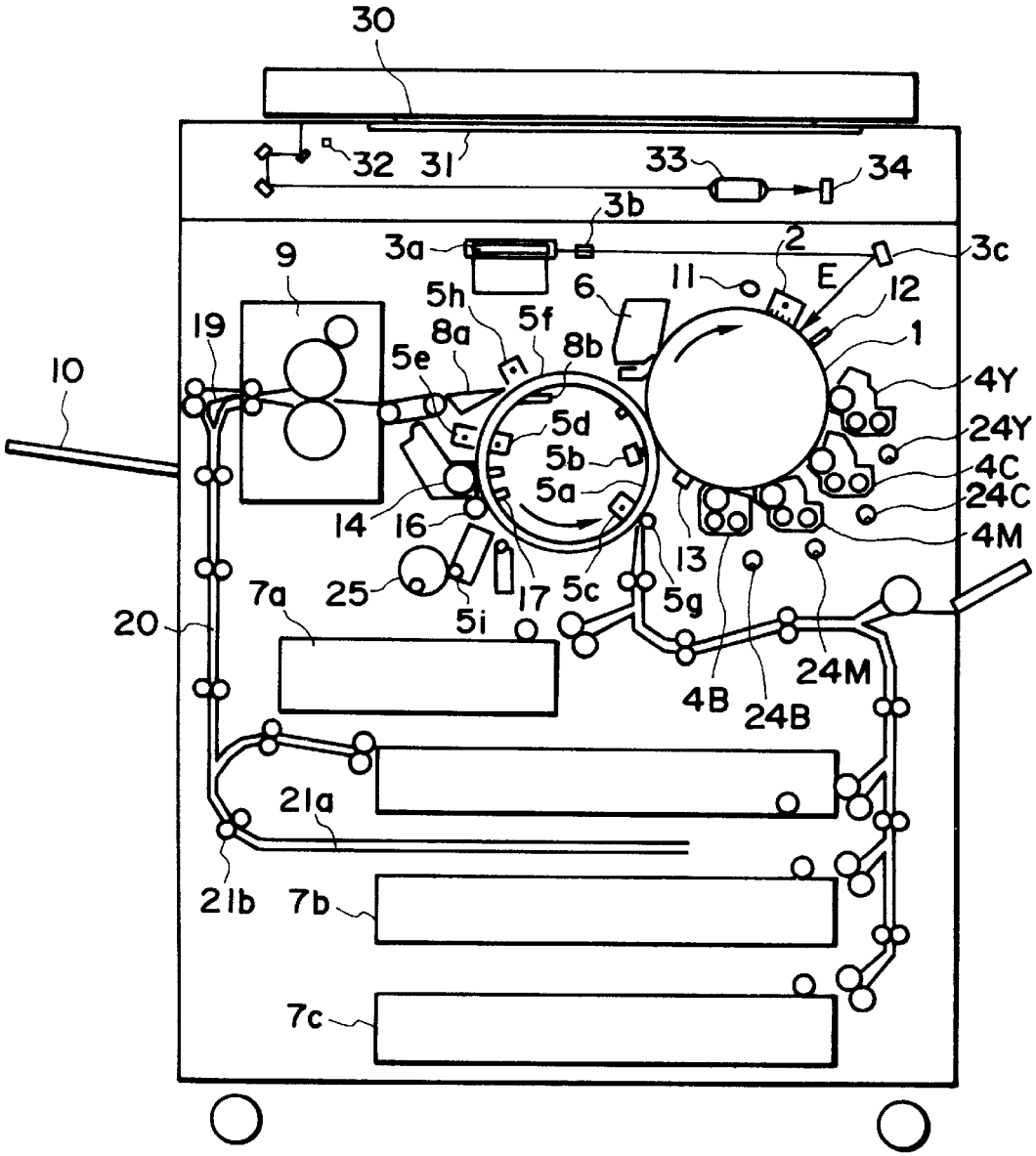
FIG. 6 is an illustration of a full-color image forming apparatus capable of practicing a color image forming method using a method toner according to the invention.

An embodiment of the color image forming method according to the present invention will now be described with reference to FIG. 6 schematically illustrating a full-color image forming apparatus suitable therefor.

More specifically, FIG. 6 is a schematic illustration of an image forming apparatus for forming a full-color image by electrophotography. The image forming apparatus shown in FIG. 6 is applicable as a full-color copying machine or a full-color printer.

In the case of using the apparatus as a fullcolor copying machine, as shown in FIG. 6, the copying apparatus includes a digital color image reader unit in an upper portion and a digital color image printer unit in a lower port.

In the image reader unit, an original 30 is placed on a glass original support 31 and is subjected to scanning exposure with an exposure lamp 32. A reflection light image from the original 30 is concentrated at a full-color sensor 34 to obtain a color separation image signal, which is transmitted to an amplifying circuit (not shown) and is transmitted to and treated with a video-treating unit (not shown) to be outputted toward the digital image printer unit.

In the image printer unit, a photosensitive drum 1 as an image-bearing member may, e.g., include a photosensitive layer comprising an organic photoconductor (OPC) and is supported rotatably in a direction of an arrow. Around the photosensitive drum 1, a pre-exposure lamp 11, a corona charger 2, a laser-exposure optical system (3*a,* 3*b,* 3*c*), a potential sensor 12, four developing devices containing developers different in color (4Y, 4C, 4M, 4B), a luminous energy (amount of light) detection means 13, a transfer device, and a cleaning device 6 are disposed.

In the laser exposure optical system, the image signal from the image reader unit is converted into a light signal for image scanning exposure at a laser output unit (not shown). The converted laser light (as the light signal) is reflected by a polygonal mirror 3*a* and projected onto the surface of the photosensitive drum via a lens 3*b* and a mirror 3*c*.

In the printer unit, during image formation, the photosensitive drum 1 is rotated in the direction of the arrow and charge-removed by the pre-exposure lamp 11. Thereafter, the photosensitive drum 1 is negatively charged uniformly by the charger 2 and exposed to imagewise light E for each separated color, thus forming an electrostatic latent image on the photosensitive drum 1.

Then, the electrostatic latent image on the photosensitive drum is developed with a prescribed toner by operating the prescribed developing deice to form a toner image on the photosensitive drum 1. Each of the developing devices 4Y, 4C, 4M and 4B performs development by the action of each of eccentric cams 24Y, 24C, 24M and 24B so as to selectively approach the photosensitive drum 1 depending on the corresponding separated color.

The transfer device includes a transfer drum 5*a,* a transfer charger 5*b,* an adsorption charger 5*c* for electrostatically adsorbing a recording material, an adsorption roller 5*g* opposite to the adsorption charger 5*c* an inner charger 5*d,* an outer charger 5*e,* and a separation charger 5*h*. The transfer drum 5*a* is rotatably supported by a shaft and has a peripheral surface including an opening portion at which a transfer sheet 5*f* as a recording material-carrying member for carrying the recording material is integrally adjusted. The transfer sheet 5*f* may include a resin film, such as a polycarbonate film.

The transfer sheet 5*f* is conveyed from any one of cassettes 7*a,* 7*b* and 7*c* to the transfer drum 5*a* via transfer sheet-carrying system, and is held thereon. The transfer sheet carried on the transfer drum 5 is repeatedly conveyed to a transfer position opposite to the photosensitive drum 1 in accordance with the rotation of the transfer drum 5. The toner image on the photosensitive drum 1 is transferred onto the transfer sheet by the action of the transfer charger 5*b* at the transfer position.

The toner image may be directly transferred to the transfer sheet as shown in FIG. 4. Further, the toner image is once transferred to an intermediate transfer member and then is retransferred from the intermediate transfer member to the transfer sheet.

The above image formation steps are repeated with respect to yellow (Y), magenta (M), cyan (C) and black (B) to form a color image comprising superposed four color toner images on the transfer sheet carried on the transfer drum 5*a*.

The transfer sheet thus subjected to transfer of the toner image (including four color images) is separated from the transfer drum 5*a* by the action of a separation claw 8*a,* a separation and pressing roller 8*b* and the separation charger 5*h* to be conveyed to heat and pressure-fixation device 9, at which the toner image on the transfer sheet is fixed under heating and pressure to effect color-mixing and color development of the toner and fixation of the toner onto the transfer sheet to form a full-color fixed image (fixed full-color image), followed by discharge thereof into a tray 10. As described above, a full-color copying operation for one sheet is completed. On the other hand, a residual toner on the surface of the photosensitive drum 1 is cleaned and removed by the cleaning device 6, and thereafter the photosensitive drum 1 is again subjected to next image formation. The cleaning member may be a fur brush or unwoven cloth instead of a blade, or can be a combination of these.

With respect to the transfer drum 5*a,* an electrode roller 14 and a fur brush 15 are oppositely disposed via the transfer sheet, and an oil-removing roller 16 and a backup brush 17 are also oppositely disposed via the transfer sheet. By using these members, powder and/or oil attached to the transfer sheet is cleaned and removed. This cleaning operation is performed before or after image formation. In case of an occurrence of jam phenomenon (paper jamming or plugging), the cleaning operation may appropriately be effected.

An eccentric cam 25 is operated at a desired timing to actuate a cam follower 5 integrally supported to the transfer drum, whereby a gap (spacing) between the transfer sheet and the photosensitive drum can be arbitrarily set. For instance, at the time of stand-by or shut-off of power supply, the gap between the transfer drum 5*a* and the photosensitive drum 1 can be made large.

A full-color fixed image is thus formed by the above image forming apparatus. In the above apparatus, image formation may appropriately be performed in a single color mode or a full color mode to provide a single color fixed image or a full color fixed image, respectively.

In the above description, an embodiment of full-color image formation using four color toners including a black toner in addition to a cyan toner, a magenta toner and a yellow toner has been described, but a full-color image formation can also be made using three chromatic color toners of a cyan toner, a magenta toner and an yellow toner while forming a black color with a mixture of the three color toners. Anyway, in the color image forming method according to the present invention, it is essential to use at least one color toner in addition to the magenta toner according to the present invention.

As described above, according to the present invention, there is provided a magenta toner capable of exhibiting a desired hue and excellent color reproducibility by including a quinacridone pigment providing a characteristic X-ray diffraction spectrum showing two diffraction peaks in a Bragg angle (2θ) region of 5–10 deg.

EXAMPLE 1

(Polyester ingredients)

| | | |
|---|---|---|
| Polyoxypropylene(2.2)-2,2-bis(4-hydroxyphenyl)propane | 30 | mol. % |
| Polyoxyethylene(2.0)-2,2-bis(4-hydroxyphenyl)propane | 70 | mol. % |
| Terephthalic acid | 30 | mol. % |
| Fumaric acid | 70 | mol. % |
| Trimellitic acid | 0.05 | mol. % |

(First kneading step)

A starting material mixture included 70 wt. parts of Polyester resin (1) obtained from the above-mentioned polyester ingredients, 50 wt. parts of a first paste pigment containing 30 wt. % (as solid matter) of γ-form quinacridone (I) condensed from a pigment slurry by removal of some water but not subjected to any drying step and remainder (70 wt. %) of water, and 50 wt. parts of a second paste pigment containing 30 wt. % of 2,9-dimethylquinacridone (II) condensed from a pigment slurry by removal of some water but not subjected to any drying step and remainder (70 wt. %) of water.

The above-mentioned starting material mixture was charged in a kneader-type mixer, blended therein and, under continuation of the blending, was heated under no pressure application. When the mixture reached a maximum temperature of ca. 90–100° C. determined by the boiling point of water (dispersion medium) contained, the migration or partition of the pigment (quinacridones) from the aqueous phase to the resin phase was confirmed and thereafter the melt-kneading under heating was further continued for 30 min. to effect a sufficient migration of the pigment to the resin phase. Thereafter, the mixer was once stopped, hot water was discharged, and then the content in the mixer was heated to 130° C. and melt lb kneaded under heating for ca. 30 min., thereby dispersing the pigment and distilling off the water to complete the kneading step. After cooling, the content was recovered as a first kneaded product, which was found to have a moisture content of ca. 0.5 wt. %.

(Second kneading step)

A starting material included the following ingredients.

| | | |
|---|---|---|
| First kneaded product prepared above (containing 30 wt. % of pigment particles) | 16.7 | wt. parts |
| Polyester resin (1) (identical to the above) | 88.3 | wt. parts |
| Di-t-butylsalicylic acid Al compound (charge control agent) | 4 | wt. parts |

The above ingredients were sufficiently preliminarily blended in a Henschel mixer and then melt-kneaded through a twin-screw extruder kneader set at 100° C. After cooling, the meltkneaded product was coarsely crushed to ca. 1–2 mm by a hammer mill and then finely pulverized by an air jet-type fine pulverizer to a particle size below 20 μm. Then, the pulverizate was classified to obtain magenta toner particles having a set volume-average particle size of 6.2 μm. Then, 100 wt. parts of the magenta toner particles were blended with 1.5 wt. parts of alumina fine powder hydrophobized with a silicon compound so as to improve the flowability and the chargeability, thereby obtaining Magenta toner (A), which exhibited a weight-average particle size of 6.5 μm.

As a result of microscopic observation of Magenta toner (A), the pigment exhibited a number-average particle size of 0.28 μm and a particle size distribution including 83% by number of particles of 0.1–0.5 μm and substantially 0% of particles of 0.8 μm or larger, thus showing a good dispersion state.

From Magenta toner (A), an insoluble measurement sample including the colorant was recovered and subjected to X-ray diffraction analysis in a manner as described above, whereby an X-ray diffraction spectrum shown in FIG. 1 was obtained. Among the peaks, peaks other than those shown in FIGS. 3 and 4 are attributable to the charge control agent contained in the toner. This was confirmed based on X-ray diffraction analysis of the charge control agent alone.

As shown in FIG. 1, the magenta pigment (quinacridone pigment) contained in Magenta toner (A) provided an X-ray diffraction spectrum exhibiting clear two peaks in a Bragg angle (2θ) range of 5–10 deg.

6.0 wt. parts of Magenta toner (A) was blended with a Cu-Zn-Fe-based ferrite carrier coated with ca. 35 wt. % of styrene/methyl methacrylate (65/35 by weight) copolymer to provide totally 100 wt. parts of a two-component type developer. Thus, the toner concentration in the two-component type developer was 6.0 wt. %.

The two-component type developer was incorporated in a magenta developing device 4M of a plain paper full-color copying machine ("CLC (Color Laser Copier) 800", available from Canon K.K.) having a structure as illustrated in FIG. 6 and subjected to a copying test. As a result, the resultant initial-stage images were clear and exhibited excellent saturation.

Further, even after 60,000 sheets of a continuous image forming test, magenta color images free from fog and faithfully reproducing an original image could be obtained at a good color reproducibility. The conveyance and the concentration detection of the developer in the copying apparatus were well performed, so that a stable image density could be obtained. Further, as a result of a repetitive copying test on 50000 sheets at a fixing temperature of 170° C., no offset at all on the fixing roller occurred as a result of observation with eyes of the fixing roller surface after the repetitive copying test.

Triboelectric charge measurement was performed in a low temperature/low humidity environment (15° C./10 %RH) and a high temperature/high humidity environment (32.5° C./85%RH), respectively, whereby the toner exhibited very little environmental dependence as represented by a charge ratio of 1.35 between the environments.

As an evaluation item of a color copied image, an image surface gloss is often measured. A higher gloss is judged to represent a glossy color image having a higher surface smoothness and a higher saturation, an a lower gloss is judged to represent a sombre image having a lower saturation and a rough image surface. The magenta developer in this Example 1 provided a magenta color image showing an image density of 1.70 (Macbeth reflection density) and a gloss of 21% at a contrast potential of 300 volts.

The gloss measurement was performed by using a gloss meter ("VG-10", available from Nippon Denshoku K.K.). For the measurement, a constant voltage of 6 volts was set by a constant voltage supply, the incident and exit angles were respectively set at 60 deg., and a standard adjustment was performed by using a 0-point adjuster and a standard plate. Thereafter, three sheets while paper were superposed on a sample support and image was placed thereon to effect the measurement by reading a % value indicated on the meter.

The image exhibited objective color indices, i.e., a*=75.2, b*=−2.3, and L*=47.3.

Toner colors were quantitatively measured according to the color space standardized by CIE in 1976. In this instance, the image density was fixed at 1.70, three indices including a* and b* (chromaticities representing a hue and a saturation) and L* (lightness). The measurement was performed by using a spectral calorimeter ("Type 938", available from X-Rite Co.), a C-light source as a light source for observation and a viewing angle of 2 deg.

Further, a color image formed on a transparency film was projected by an overhead projector (OHP), whereby a good transparency of the OHP image was exhibited. More specifically, the transparency of the OHP image was evaluated according to the following standard:

A (good): Excellent transparency, free from bright-dark irregularity and excellent color reproducibility.

B (fair): Some bright-dark irregularity was present but was at a practically acceptable level.

C (not acceptable): Bright-dark irregularity was present and the color reproducibility was poor.

A resultant solid image (image density=1.70) was examined with respect to light-fastness substantially according to JIS K7102, whereby an image after 400 hours of illumination with light from a carbon arc lamp showed an image density of 1.68 substantially identical to that of the initial image and indicated substantially no color change as represented by ΔE=2.8 calculated by the following equation:

$$\Delta E=\{(L1^*-L2^*)^2+(a1^*-a2^*)^2+(b1^*-b2^*)^2\}^{1/2},$$

wherein L1*, a1* and b1* denote three color indices before the illumination, and L2*, a2* and b2* denote three color indices after the illumination.

A light-fastness evaluation may be made according to the following standard:

A: Substantially no change after 400 hours.

B: Substantially no change after 200 hours.

C: Fading observed after 100 hours.

Secondary colors of green, red and blue as well as primary colors were reproduced by using commercially available yellow toner and cyan toner (for "CLC 800") and the above-prepared Magenta toner (A), whereby the reproduced images exhibited the following parameters shown in Table 1, wherein data for a red image obtained by using the cyan toner and a magenta prepared in Comparative Example 1 described hereinafter are also shown for reference.

TABLE 1

| Produced image | Toner weight (mg/cm$^2$) | Gloss (%) | a* | b* | L* |
|---|---|---|---|---|---|
| Magenta | 0.8 | 21 | 75.2 | −2.3 | 47.3 |
| Cyan | 0.8 | 17 | −20.0 | −48.1 | 52.1 |
| Yellow | 0.8 | 20 | −16.2 | 95.4 | 86.2 |
| Blue | 1.6 | 29 | 46.0 | −43.2 | 20.3 |
| Red | 1.6 | 30 | 63.6 | 53.3 | 45.2 |
| Red (Comp. Ex. 1) | 1.6 | 31 | 59.8 | 45.2 | 40.9 |

Reproduced secondary color images exhibited high lightness and saturation, including a remarkably increased saturation (c*) of 83.0 for the red image compared with 75.0 of a red image obtained by using a magenta toner of Comparative Example 1, respectively, compared with 75.0 of a red image.

Further, by using commercially available yellow toner, cyan toner and black toner (for "CLC 800") together with the above-prepared Magenta toner (A), a full-image was formed by using the abovementioned commercial image forming apparatus ("CLC 800") used in Example 1 above, whereby clear full-color images excellent in color reproducibility and rich in saturation as a whole were obtained.

The results of evaluation are summarized in Table 2 appearing hereinafter together with those of Magenta toners prepared in other Examples and Comparative Examples.

EXAMPLE 2

(First kneading step)

| | |
|---|---|
| Polyester resin (1) (same as in Example 1) | 70 wt. parts |
| γ-form quinacridone (I) in dry-powder form | 15 wt. parts |
| 2,9-dimethylquinacridone (II) in dry powder form | 15 wt. parts |

The above ingredients were charged in a kneader-type mixer and blended and heated up to 130° C. under no pressure while continuing the blending to effect a sufficient preliminary blending for ca. 1 hour, and the preliminary blend was melt-kneaded two times at 135° C. through a three roll mill, and after cooling, a first kneaded product was recovered.

(Second kneading step)

The second kneading step was performed by using the above-prepared first kneaded product otherwise in the same manner as in Example 1 to obtain magenta toner particles and Magenta toner (B) therefrom.

As a result of evaluation, Magenta toner (B) provided results shown in Table 2, thus showing somewhat lower saturation and lightness but providing generally objective colors of images.

As a result of microscopic observation of pigment dispersion state in Magenta toner (B), the pigment exhibited a number-average particle size of 0.42 μm and a particle size distribution including 61% by number of particles of 0.1–0.5 μm and 5% of particles of 0.8 μm or larger, thus showing a somewhat inferior dispersion state than in Magenta toner (A) of Example 1.

Comparative Example 1

A first kneading step was performed in a similar manner except for using no first paste pigment of γ-form quinacridone (I) but using only 70 wt. parts of Polyester resin (1) and 100 wt. parts of the second paste pigment containing 30 wt. % (as solid matter) of 2,9-dimethylquinacridone (II). The resultant first kneaded product was thereafter subjected to a second kneading step and a post-treatment in similar manners as in Example 1 to obtain Magenta toner (C).

As a result of evaluation in the same manner as in Example 1, the toner provided a high image density of 1.85 at the initial stage but failed to provide an image of an objective hue.

A secondary color of red was reproduced by using a commercially available yellow toner(for "CLC 800") and Magenta toner (C) in the laser color copier ("CLC 800"), whereby the resultant red image exhibited chromaticities (a*, b*) of 75.0 (compared with 86.0 in Example 1), and the reproducible color region of red was remarkably narrowed compared with the case in Example 1.

Comparative Example 2

A first kneading step was performed in a similar manner except for using no second paste pigment of 2,9-dimethylquinacridone (II) but using only 70 wt. parts of Polyester resin (1) and 100 wt. parts of the second paste pigment containing 30 wt. % (as solid matter) of γ-form quinacridone (I). The resultant second kneaded product was thereafter subjected to a first kneading step and a post-treatment in similar manners as in Example 1 to obtain Magenta toner (D).

As a result of evaluation in the same manner as in Example 1, the toner provided a low image density of 1.42 at the initial stage and, even at an increased contrast potential of 400 volts, the image density could be increased only up to 1.63. The chromaticities at that time were a*=68.7 and b*=10.5, and failed to provide a toner of an objective hue.

A secondary color of blue was reproduced by using a commercially available cyan toner(for "CLC 800") and Magenta toner (D) in the laser color copier ("CLC 800"), whereby the reproducible color region of blue was remarkably narrowed compared with the case in Example 1.

Comparative Example 3

(First kneading step)

| | | |
|---|---|---|
| Polyester resin (1) (same as in Example 1) | 70 | wt. parts |
| C.I. Pigment Red 57:1 | 30 | wt. parts |

The above ingredients were charged in a kneader-type mixer and blended and heated under no pressure while continuing the blending to effect a sufficient preliminary blending, and the preliminary blend was melt-kneaded two times through a three roll mill, and after cooling, a first kneaded product was recovered (Second kneading step)

The second kneading step was performed by using the above-prepared first kneaded product otherwise in the same manner as in Example 1 to obtain magenta toner particles and Magenta toner (E) therefrom.

Magenta toner (E), based on a pigment recovered therefrom, provided an X-ray diffraction spectrum showing no clear peak in a Bragg angle (2θ) region of 5–10 de. and was a magenta toner with a remarkably reddish tint.

Magenta toner (E) showed a low initial-stage charge in a high temperature/high humidity environment, presumably because of moisture affinity to Ca ions contained in the pigment used. As a result of light-fastness evaluation, Magenta toner (E) provided a large ΔE of 6.8 after 100 hours of illumination.

Comparative Example 4

(First kneading step)

| | | |
|---|---|---|
| Polyester resin (1) (same as in Example 1) | 70 | wt. parts |
| Hoster pern Pink 02 | 30 | wt. parts |

(made by Hoechst AG) (a commercially available pigment, comprising a mixed crystal of quinacridone (I) and 2,9-dimethylquinacridone (II))

The above ingredients were charged in a kneader-type mixer and blended and heated under no pressure while continuing the blending to effect a sufficient preliminary blending, and the preliminary blend was melt-kneaded two times through a three roll mill, and after cooling, a first kneaded product was recovered.

(Second kneading step)

The second kneading step was performed by using the above-prepared first kneaded product otherwise in the same manner as in Example 1 to obtain magenta toner particles and Magenta toner (F) therefrom.

As a result of evaluation, Magenta toner (F) provided results shown in Table 2, thus showing somewhat lower saturation and lightness but providing generally objective colors of images.

Magenta toner (F), based on a pigment recovered therefrom, provided an X-ray diffraction spectrum showing one clear peak in a Bragg angle (2θ) region of 5–10 de. and was a magenta toner with a remarkably bluish tint.

Magenta toner (F) showed a high initial-stage image density of 1.80 but exhibited a high charge in a low temperature/low humidity environment and the image density was gradually lowered in a continuous image formation.

Example 3

Magenta toner (G) was prepared in substantially similar manners as in Example 1 except for using 100 wt. parts of styrene/n-butyl acrylate copolymer resin (Tg=60° C.).

Magenta toner (G) provided magenta images of good hue in the respective environments. However, when used for providing secondary colors of green, red and blue in combination with commercially available yellow toner an cyan toner (for "CLC 800"), the secondary colors exhibited a somewhat lower reproducibility including a lower saturation and provided an OHP transparency film showing a lower transparency than in Example 1, presumably because of a lower color mixability due to a change of binder resin from a polyester resin to a styrene-based resin. Further, slight fog was observed under the respective environmental conditions. However, all the results were within a practically acceptable level.

Comparative Example 5

Magenta toner (H) was prepared in the same manner as in Example 1 except that, after the hot water discharge in the first kneading step, the content in the kneader mixer was further heated to 160° C. and melt-kneaded at that temperature for further ca. 2 hours.

Magenta toner (H), based on an insoluble matter recovered therefrom including the pigment, provided an X-ray diffraction spectrum showing only one broad beak in a Bragg angle (2θ) region of 5–10 deg.

As a result of evaluation, in the same manner as in Example 1, Magenta toner (H) provided a turbid magenta image tinged with violetish tint and lowered in both lightness and saturation.

Comparative Example 6

Magenta toner (I) was prepared in the same manner as in Example 1 except the starting ingredients in the first kneading step were changed to 50 wt. parts of Polyester resin (1), 100 wt. parts of the first paste pigment containing 30 wt. % of γ-form quinacridone (I) and 100 wt. parts of the second paste pigment containing 30 wt. % of 2,9-dimethylquinacridone (II) to effect the first kneading step, and the first kneaded product was further subjected to eight times of melt-kneading through a three roll mill before it was introduced into the second kneading step.

Magenta toner (I), based on an insoluble matter recovered therefrom including the pigment, provided an X-ray diffraction spectrum showing only one broad beak in a Bragg angle (2θ) region of 5–10 deg.

As a result of evaluation, in the same manner as in Example 1, Magenta toner (I) clearly failed to exhibit an objective hue.

Comparative Example 7

Magenta toner (J) was prepared in the same manner as in Example 2 except that the first kneading step was performed by using starting ingredients comprising 70 wt. parts of Polyester resin (1) (same as in Example 1), 40 wt. parts of γ-form quinacridone (I) in dry-powder form and 40 wt. parts of 2,9-dimethylquinacridone (II) in dry-powder form, blending the ingredients foro 3 min. in a Henschel mixer instead of the kneader mixer, and effecting 5 times of the melt-kneading through a three roll mill.

Magenta toner (J), based on an insoluble matter recovered therefrom including the pigment, provided an X-ray diffraction spectrum showing only one broad beak in a Bragg angle (2σ) region of 5–10 deg.

As a result of evaluation, in the same manner as in Example 1, Magenta toner (J) provided a turbid magenta image tinged with violetish tint and lowered in both lightness and saturation.

TABLE 2

| Evaluation of magenta toners | | | | | | | | | | | |
|---|---|---|---|---|---|---|---|---|---|---|---|
| Ex. or Comp. Ex. | | Magenta toner | Pigment peaks Number (peak position; deg.) | Initial stage HT/HH (μc/g) | Initial stage LT/LH (μc/g) | Color indices a* | Color indices b* | Color indices L* | Gloss (%) | OHP | Light-fastness |
| Ex. | 1 | (A) | 2 (5.4, 6.4) | −23 | −31 | 75.2 | −2.3 | 47.3 | 21 | A | A |
| | 2 | (B) | 2 (5.4, 6.4) | −22 | −31 | 72.8 | −3.4 | 46.2 | 19 | B | B |
| | 3 | (G) | 2 (5.5, 6.4) | −22 | −35 | 71.2 | −3.3 | 45.4 | 14 | B | A |
| Comp. Ex. | 1 | (C) | 1 (5.4) | −19 | −28 | 71 .3 | −22.0 | 44.6 | 20 | B | A |
| | 2 | (D) | 1 (6.4) | −24 | −33 | 68.7 | 10.5 | 48.8 | 20 | A | A |
| | 3 | (E) | no clear peak | −15 | −34 | 72.5 | 8.2 | 42.7 | 18 | B | C |
| | 4 | (F) | 1 (5.5) | −25 | −40 | 70.2 | −18.1 | 43.0 | 16 | B | B |
| | 5 | (H) | 1 (broad) (5.6) | −19 | −29 | 70.6 | −12.9 | 42.1 | 24 | A | B |
| | 6 | (I) | 1 (broad) (5.5) | −20 | −30 | 68.2 | −14.9 | 42.5 | 21 | A | B |
| | 7 | (J) | 1 (broad) (5.5) | −21 | −28 | 66.3 | −15.6 | 42.7 | 22 | A | B |

What is claimed is:

1. A magenta toner for developing electrostatic images, comprising: a binder resin, and a quinacridone pigment composition providing an X-ray diffraction spectrum showing two peaks in a Bragg angle (2θ) region of 5–10 deg, wherein said quinacridone pigment composition comprises non-substituted quinacridone and 2.9-dimethylquinacridone.

2. The magenta toner according to claim 1, wherein said non-substituted quinacridone has a γ-form crystal structure.

3. The magenta toner according to claim 1, wherein the quinacridone pigment composition is dispersed in a number-average particle size of at most 0.7 μm.

4. The magenta toner according to claim 3, wherein the quinacridone pigment composition is dispersed in such a particle size distribution as to contain at least 60% by number of particles having particle sizes of 0.1–0.5 μm and at most 10% by number of particles having particle sizes of 0.8 μm or larger.

5. The magenta toner according to claim 1, wherein the non-substituted quinacridone and the 2,9-dimethylquinacridone are contained in a weight ratio of 10:90–90:10.

6. The magenta toner according to claim 1, wherein the quinacridone pigment composition is contained in 2–5 wt. parts per 100 wt. parts of the binder resin.

7. The magenta toner according to claim 1, wherein the binder resin comprises a polyester resin.

8. The magenta toner according to claim 7, wherein the polyester resin has an acid value of 2–25 mgKOH/g.

9. The magenta toner according to claim 7, wherein the polyester resin has a glass transition temperature of 50–75° C.

10. The magenta toner according to claim 1, wherein the magenta toner contains a release agent.

11. The magenta toner according to claim 1, wherein the magenta toner is in a powdery mixture with a flowability improving agent externally added thereto.

12. The magenta toner according to claim 1, wherein the magenta toner has a weight-average particle size of 3–10 μm.

13. A two-component type developer, comprising: a magenta toner and a carrier;

wherein the magenta toner comprises a binder resin, and a quinacridone pigment composition providing an X-ray diffraction spectrum showing two peaks in a Bragg angle (2θ) region of 5–10 deg, wherein said quinacridone pigment composition comprises non-substituted quinacridone and 2,9-dimethylquinacridone.

14. The developer according to claim 13, wherein said non-substituted quinacridone has a γ-form crystal structure.

15. The developer according to claim 13, wherein the quinacridone pigment composition is dispersed in a number-average particle size of at most 0.7 μm in the magenta toner.

16. The developer according to claim 15, wherein the quinacridone pigment composition is dispersed in the magenta toner in such a particle size distribution as to contain at least 60% by number of particles having particle sizes of 0.1–0.5 μm and at most 10% by number of particles having particle sizes of 0.8 μm or larger.

17. The developer according to claim. 13, wherein the non-substituted quinacridone and the 2,9-dimethylquinacridone are contained in a weight ratio of 10:90–90:10.

18. The developer according to claim 13, wherein the quinacridone pigment composition is contained in 2–5 wt. parts per 100 wt. parts of the binder resin.

19. The developer according to claim 13, wherein the binder resin comprises a polyester resin.

20. The developer according to claim 19, wherein the polyester resin has an acid value of 2–25 mgKOH/g.

21. The developer according to claim 19, wherein the polyester resin has a glass transition temperature of 50–75° C.

22. The developer according to claim 13, wherein the magenta toner contains a release agent.

23. The developer according to claim 13, wherein the magenta toner is in a powdery mixture with a flowability improving agent externally added thereto.

24. The developer according to claim 13, wherein the magenta toner has a weight-average particle size of 3–10 μm.

25. The developer according to claim 13, wherein the carrier comprises particles of a member selected from the group consisting of magnetic metals, alloys of magnetic metals, oxides of magnetic metals and magnetic ferrites.

26. The developer according to claim 13, wherein the carrier is in the form of a coated carrier comprising a carrier core and a coating material coating the carrier core.

27. The developer according to claim 13, wherein the carrier has an average particle size of 10–100 μm.

28. The developer according to claim 26, wherein the carrier is in the form of a resin-coated carrier comprising magnetic ferrite core particles coated with a silicone resin, or a mixture of a fluorine-containing resin and a styrene resin.

29. A color image forming method, comprising:

forming a color toner image on a recording material with a combination of a magenta toner and at least one color toner selected from a cyan toner and a yellow toner, and fixing the color toner image onto the recording material;

wherein the magenta toner comprises a binder resin, and a quinacridone pigment composition providing an X-ray diffraction spectrum showing two peaks in a Bragg angle (2θ) region of 5–10 deg, wherein said quinacridone pigment composition comprises non-substituted quinacridone and 2,9-dimethylquinacridone.

30. The image forming method according toclaim 29, wherein said non-substituted quinacridone has a γ-form crystal structure.

31. The image forming method according to claim 29, wherein the quinacridone pigment composition is dispersed in a number-average particle size of at most 0.7 μm in the magneta toner.

32. The image forming method according to claim 31, wherein the quinacridone composition pigment is dispersed in the magenta toner in such a particle size distribution as to contain at least 60% by number of particles having particle sizes of 0.1–0.5 μm and at most 10% by number of particles having particle sizes of 0.8 μm or larger.

33. The image forming method according to claim 29, wherein the non-substituted quinacridone and the 2,9-dimethylquinacridone are contained in a weight ratio of 10:90–90:10 in the magenta toner.

34. The image forming method according to claim 29, wherein the quinacridone pigment composition is contained in 2–5 wt. parts per 100 wt. parts of the binder resin.

35. The image forming method according to claim 29, wherein the binder resin comprises a polyester resin.

36. The image forming method according to claim 35, wherein the polyester resin has an acid value of 2–25 mgKOH/g.

37. The image forming method according to claim 35, wherein the polyester resin has a glass transition temperature of 50–75° C.

38. The image forming method according to claim 29, wherein the magenta toner contains a release agent.

39. The image forming method according to claim 29, wherein the magenta toner is in a powdery mixture with a flowability improving agent externally added thereto.

40. The image forming method according to claim 29, wherein the magenta toner has a weight-average particle size of 3–10 μm.

41. The image forming method according to claim 29, wherein the color toner image comprises the magenta toner, the cyan toner and the yellow toner and is fixed onto the recording material to form a full-color image thereon.

42. The image forming method according to claim 29, wherein the color toner image comprises the magenta toner, the cyan toner, the yellow toner and also a black toner and is fixed onto the recording material to form a full-color image thereon.

43. A process for producing a magenta toner, comprising the steps of:

blending a first binder resin, a first paste pigment (I) comprising a first dispersion medium and non-substituted quinacridone in a proportion of 5–50 wt. % of the first paste pigment, and a second paste pigment (II) comprising a second dispersion medium and 2,9-dimethylquinacridone in proportion of 5–50 wt. % of the second paste pigment, under heating and under no pressure to melt the first binder resin, causing the quinacridone in the first paste pigment (I) and the 2,9-dimethylquinacridone in the second paste pigment (II) to migrate into the melted first binder resin, melt-kneading the first binder resin, the quinacridone and the 2,9-dimethylquinacridone to form a first kneaded product, drying the first kneaded product, melt-kneading a blend of the first kneaded product and a second binder resin to form a second kneaded product, cooling and pulverizing the second melt-kneaded product to obtain a magenta toner so that the magenta toner contains a quinacridone pigment providing an X-ray diffraction spectrum exhibiting two peaks in a Bragg angle (2θ) range of 5–10 deg.

44. The process according to claim 43, wherein the non-substituted quinacridone has a γ-form crystal structure.

45. The process according to claim 43, wherein the first dispersion medium and the second dispersion medium respectively comprise water.

46. The process according to claim 43, wherein the first binder resin and the second binder resin has substantially identical resin compositions.

47. The process according to claim 43, wherein the first binder resin and the second binder resin respectively comprise a polyester resin.

* * * * *

UNITED STATES PATENT AND TRADEMARK OFFICE

CERTIFICATE OF CORRECTION

PATENT NO. : 5,912,099

DATED : June 15, 1999

INVENTOR(S) : MAKOTO KANBAYASHI ET AL.

It is certified that error appears in the above-identified patent and that said Letters Patent is hereby corrected as shown below:

ON THE TITLE PAGE [30]

Foreign Application Priority Data, "Aug. 2, 1997" should read --Aug. 2, 1996--.

COLUMN 1

Line 16, "system has" should read --systems have--.

COLUMN 3

Line 51, "provide" should read --provides--; and
Line 56, "and fixing" should read --and ¶ fixing--.

COLUMN 5

Line 5, "referrd to a quinacridone" should read --referred to as a quinacridone (II)):--; and
Line 25, "poorer" should read --poor--.

COLUMN 6

Line 1, "(20)" should read --(2θ)--; and
Line 41, "in" should be deleted.

COLUMN 7

Line 7, "case" should read --the case--;
Line 25, "as" should be deleted; and
Line 62, "substrac-" should read --subtrac- --.

UNITED STATES PATENT AND TRADEMARK OFFICE

CERTIFICATE OF CORRECTION

PATENT NO. : 5,912,099

DATED : June 15, 1999

INVENTOR(S) : MAKOTO KANBAYASHI ET AL.

It is certified that error appears in the above-identified patent and that said Letters Patent is hereby corrected as shown below:

COLUMN 8

Line 14, "an" should read --and--;
Line 36, "butadiene." should read --butadiene--;
Line 47, "umidity" should read --humidity--;
Line 48, "hargeability" should read --chargeability--; and
Line 49, "nvironment." should read --environment.--.

COLUMN 9

Line 46, "In" should read --In the--; and
Line 64, "god" should read --good--.

COLUMN 10

Line 12, "In" should read --In the--;
Line 15, "autioffset" should read --anti-offset--;
Line 20, "In" should read --In the--;
Line 25, "enon" should read --ena--; and
Line 29, "In" should read --In the--.

COLUMN 11

Line 17, "farm" should read --form--; and
Line 57, "pigmentfirst" should read --pigment-first--.

COLUMN 12

Line 2, "par-" should read --and part- --; and
Line 65, "resin-may" should read --resin may--.

UNITED STATES PATENT AND TRADEMARK OFFICE

CERTIFICATE OF CORRECTION

PATENT NO. : 5,912,099

DATED : June 15, 1999

INVENTOR(S) : MAKOTO KANBAYASHI ET AL.

It is certified that error appears in the above-identified patent and that said Letters Patent is hereby corrected as shown below:

COLUMN 13

Line 18, "case" should read --the case--.

COLUMN 14

Line 9, "an fine" should read --and fine--;
Line 31, "an it" should read --and it--;
Line 40, "so that" should be deleted; and
Line 57, "case" should read --the case--.

COLUMN 15

Line 9, "dies" should read --dyes--;
Line 10, "are however" should read --are, however,--;
Line 26, "90:10" should read --90:10- --; and
Line 64, "and" should be deleted.

COLUMN 16

Line 12, "ample" should read --sample--.

COLUMN 17

Line 19, "includes" should read --include--; and
Line 44, "fullcolor" should read --full-color--.

COLUMN 18

Line 13, "deice" should read --device--; and
Line 22, "5c an" should read --5c, an--.

UNITED STATES PATENT AND TRADEMARK OFFICE

CERTIFICATE OF CORRECTION

PATENT NO. : 5,912,099

DATED : June 15, 1999

INVENTOR(S) : MAKOTO KANBAYASHI ET AL.

It is certified that error appears in the above-identified patent and that said Letters Patent is hereby corrected as shown below:

COLUMN 19

Line 26, "an yellow" should read --a yellow--.

COLUMN 20

Line 7, "melt lb kneaded" should read --melt-kneaded--; and
Line 25, "meltkneaded" should read --melt-kneaded--.

COLUMN 21

Line 21, "an a" should read --and a--;
Line 33, "while" should read --of white--; and
Line 44, "calorimeter" should read --colorimeter--.

COLUMN 22

Line 36, "full-image" should read --full-color image--.

COLUMN 23

Line 28, "toner(for" should read --toner (for--; and
Line 53, "toner(for" should read --toner (for--.

COLUMN 24

Line 4, "recovered" should read --recovered.--; and
Line 64, "an" should read --and--.

UNITED STATES PATENT AND TRADEMARK OFFICE

CERTIFICATE OF CORRECTION

PATENT NO. : 5,912,099

DATED : June 15, 1999

INVENTOR(S) : MAKOTO KANBAYASHI ET AL.

It is certified that error appears in the above-identified patent and that said Letters Patent is hereby corrected as shown below:

COLUMN 26

Line 14, "foro" should read --for--; and
Line 21, "(2σ)" should read --(2θ)--.

COLUMN 28

Line 28, "composition pigment" should read --pigment composition--.

COLUMN 30

Line 17, "has" should read --have--.

Signed and Sealed this

Twenty-first Day of March, 2000

*Attest:*

*Attesting Officer*

Q. TODD DICKINSON

*Commissioner of Patents and Trademarks*